US011031694B2

(12) United States Patent
Itou et al.

(10) Patent No.: US 11,031,694 B2
(45) Date of Patent: Jun. 8, 2021

(54) ANTENNA

(71) Applicant: Yazaki Corporation, Tokyo (JP)

(72) Inventors: Eita Itou, Susono (JP); Kunihiko Yamada, Susono (JP); Yoshikazu Nagashima, Susono (JP); Kenji Matsushita, Yokosuka (JP); Tatsuo Toba, Yokosuka (JP)

(73) Assignee: YAZAKI CORPORATION, Tokyo (JP)

( * ) Notice: Subject to any disclaimer, the term of this patent is extended or adjusted under 35 U.S.C. 154(b) by 22 days.

(21) Appl. No.: 16/777,238

(22) Filed: Jan. 30, 2020

(65) Prior Publication Data

US 2020/0168994 A1 May 28, 2020

Related U.S. Application Data

(63) Continuation of application No. PCT/JP2018/018107, filed on May 10, 2018.

(30) Foreign Application Priority Data

Aug. 2, 2017 (JP) ..... JP2017-149871

(51) Int. Cl.

| | |
|---|---|
| ***H01Q 21/00*** | (2006.01) |
| ***H01Q 7/00*** | (2006.01) |
| ***H01Q 21/24*** | (2006.01) |

(52) U.S. Cl.

CPC ..... *H01Q 7/00* (2013.01); *H01Q 21/24* (2013.01)

(58) Field of Classification Search

CPC ..... H01Q 21/24; H01Q 1/3208; H01Q 7/00
USPC ..... 343/867
See application file for complete search history.

(56) References Cited

U.S. PATENT DOCUMENTS

| | | | | |
|---|---|---|---|---|
| 4,907,008 A * | 3/1990 | Dienes | H01Q 21/12 | 343/727 |
| 5,103,238 A * | 4/1992 | Mahnad | H01Q 21/26 | 343/796 |
| 6,522,302 B1 * | 2/2003 | Iwasaki | H01Q 9/16 | 343/725 |
| 7,243,610 B2 * | 7/2007 | Ishii | H01J 37/32192 | 118/723 AN |

(Continued)

FOREIGN PATENT DOCUMENTS

| | | |
|---|---|---|
| JP | 2007-128321 A | 5/2007 |
| JP | 2008-135932 A | 6/2008 |

*Primary Examiner* — Jean B Jeanglaude

(74) *Attorney, Agent, or Firm* — Sughrue Mion, PLLC

(57) ABSTRACT

In an antenna, the outer conductor is formed of a first linear conductor, the first linear conductor having a length corresponding to one wavelength of a right-handed circularly polarized wave and circularly extended from a first feed point to a second feed point. The inner conductor is disposed inside the outer conductor and formed of a second linear conductor, the second linear conductor being different from the first linear conductor and having a length determined based on one wavelength of a left-handed circularly polarized wave. The inner conductor has a starting point of the second linear conductor connected to the first feed point and has an end point of the second linear conductor kept free from connection at a location inside the outer conductor, and causes current to flow in a direction opposite to the current flow in the outer conductor.

8 Claims, 21 Drawing Sheets

(56) References Cited

U.S. PATENT DOCUMENTS

| | | | | |
|---|---|---|---|---|
| 8,860,620 | B2 * | 10/2014 | Kitano | H01Q 11/08 343/791 |
| 9,466,888 | B2 * | 10/2016 | Rogers | H01Q 19/06 |
| 9,680,224 | B2 * | 6/2017 | Parsche | H01Q 25/00 |
| 10,734,726 | B2 * | 8/2020 | Fujimoto | H01Q 9/40 |
| 2004/0095074 | A1 * | 5/2004 | Ishii | H01J 37/3244 315/111.21 |
| 2012/0268336 | A1 * | 10/2012 | Kitano | H01Q 11/08 343/790 |
| 2014/0361942 | A1 * | 12/2014 | Parsche | H01Q 21/24 343/743 |
| 2015/0054702 | A1 * | 2/2015 | Rogers | H01Q 13/08 343/753 |

* cited by examiner

ANTENNA

CROSS-REFERENCE TO RELATED APPLICATION

This application is a continuation application of International Application PCT/JP2018/018107, filed on May 10, 2018 which claims the benefit of priority from Japanese Patent application No.2017-149871 filed on Aug. 2, 2017 and designating the U.S., the entire contents of which are incorporated herein by reference.

BACKGROUND OF THE INVENTION

1. Field of the Invention

The present invention relates to an antenna.

2. Description of the Related Art

Some conventional antennas receive circularly polarized waves. For example, Japanese Patent Application Laid-open No. 2007-128321 describes a patch antenna that receives a right-handed circularly polarized wave transmitted from an electronic toll collection system (ETC).

Unfortunately, the patch antenna of Japanese Patent Application Laid-open No. 2007-128321 occasionally receives a right-handed circularly polarized wave and a left-handed circularly polarized wave at the same time, which may reduce the level of discrimination between the circularly polarized waves. There remains room for improvement in this point.

SUMMARY OF THE INVENTION

To overcome the above problem, the present invention aims to provide an antenna capable of properly receiving a circularly polarized wave to be received.

In order to solve the above mentioned problem and achieve the object, an antenna according to the present invention includes an outer conductor formed of a first linear conductor, the first linear conductor having a length corresponding to one wavelength of either one of a right-handed circularly polarized wave and a left-handed circularly polarized wave, circularly extended from a first end to a second end, and causing current to flow between the first end and the second end; and an inner conductor disposed inside the outer conductor, the inner conductor including a curved portion formed with a second linear conductor curvedly extended between a starting point and an end point, the second linear conductor having a length determined based on one wavelength of another one of the right-handed circularly polarized wave and the left-handed circularly polarized wave, and being different from the first linear conductor, the inner conductor having the starting point connected to either one of the first end and the second end, having the end point kept free from connection at a location inside the outer conductor, and causing current to flow in a direction opposite to a flow in the outer conductor.

According to another aspect of the present invention, in the antenna, it is preferable that the outer conductor and the inner conductor are mounted on a mounting surface, when the outer conductor receives the right-handed circularly polarized wave, the inner conductor is extended counterclockwise from the starting point to the end point in a top-down view of the mounting surface, and when the outer conductor receives the left-handed circularly polarized wave, the inner conductor is extended clockwise from the starting point to the end point in a top-down view of the mounting surface.

According to still another aspect of the present invention, in the antenna, it is preferable that the inner conductor has a circular portion circularly formed as the curved portion.

According to still another aspect of the present invention, in the antenna, it is preferable that the inner conductor has a rectangular portion rectangularly formed as the curved portion.

According to still another aspect of the present invention, in the antenna, it is preferable that the inner conductor has an L-shaped portion formed in a shape of L, as the curved portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the present invention will now be described in detail with reference to the drawings. The following description of the embodiments is not intended to limit the present invention. Components in the following description include what are easily conceived by the skilled person and what are substantially the same. The configurations described below can be combined as appropriate. Various omissions, substitutions, and changes in the configurations can be made without departing from the scope of the present invention.

First Embodiment

An antenna 1 according to a first embodiment will now be described. The antenna 1 is, for example, an antenna to receive a right-handed circularly polarized wave of a global positioning system (GPS). The right-handed circularly polarized wave of the GPS has, for example, a frequency of 1.575 GHz. The antenna 1 is made by, for example, printing conductor patterns in silver paste or the like on a polyethylene terephthalate (PET) film; however, without being limited thereto, the antenna 1 may be made using conductive ink, conductive thin film, and others. The antenna 1 is, for example, mounted on a vehicle, particularly, mounted on a dielectric mounting surface 2 such as the inside of the roof, the front windshield, the instrument panel (made of resin) of the vehicle. The antenna 1 will now be described in detail.

Figure 1:
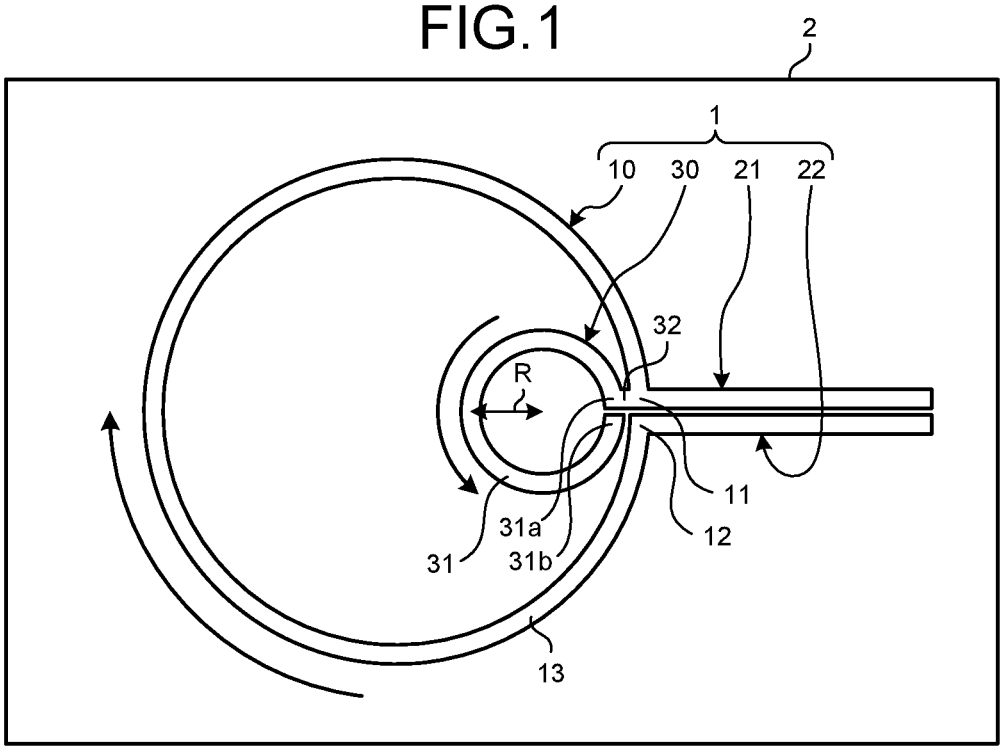
FIG. 1 is a front view of an example configuration of an antenna according to a first embodiment.

As illustrated in FIG. 1, the antenna 1 includes an outer conductor 10, first and second feedlines 21 and 22, and an inner conductor 30. The outer conductor 10 is, for example, an antenna to receive a right-handed circularly polarized wave of a GPS. The outer conductor 10 is arranged on the mounting surface 2 and includes a first feed point 11 at an end thereof and a second feed point 12 at the other end thereof, and a body 13. In the first embodiment, for example, the first feed point 11 is the negative electrode, and the second feed point 12 is the positive electrode. The body 13 is formed of a first linear conductor circularly extended from the first feed point 11 to the second feed point 12. The first linear conductor has a length corresponding to one wavelength of the right-handed circularly polarized wave of a GPS. The body 13 has a gap between the first feed point 11 and the second feed point 12. Current travels in the outer conductor 10, specifically, between the first feed point 11 and the second feed point 12 along the circumferential direction of the body 13. In the first embodiment, since the outer conductor 10 receives a right-handed circularly polarized wave of a GPS, current travels clockwise between the first feed point 11 and the second feed point 12 in the top-down view of the mounting surface 2. In other words, when the outer conductor 10 receives the right-handed circularly polarized wave, current flows from the second feed point 12, as the positive electrode, toward the first feed point 11, as the negative electrode.

The first and second feedlines 21 and 22 are, for example, conductive wires to pass current received by the body 13. The first feedline 21 has an end connected to the first feed point 11 of the outer conductor 10 and has the other end to a receiving circuitry (not illustrated). Likewise, the second feedline 22 has an end connected to the second feed point 12 of the outer conductor 10 and has the other end to the receiving circuitry. The first and second feedlines 21 and 22 pass current received by the body 13 to the receiving circuitry.

The inner conductor 30 is used to control receipt of a left-handed circularly polarized wave. The inner conductor 30 is mounted on the mounting surface 2, inside the outer conductor 10, and includes a circular portion 31 as a curved portion and a connection portion 32. The circular portion 31 and the connection portion 32 are formed of a second linear conductor different from the first linear conductor. The second linear conductor has a length determined based on one wavelength of a left-handed circularly polarized wave of a GPS. The circular portion 31 is circularly formed with a starting point 31*a* of the second linear conductor connected to the first feed point 11 as the negative electrode through the connection portion 32 and with an end point 31*b* of the second linear conductor kept free from connection at a location inside the outer conductor 10. The circular portion 31 has a gap between the starting point 31*a* and the end point 31*b*. The inner conductor 30 is designed such that current flows in a direction opposite to the current flow in the outer conductor 10. Specifically, the circular portion 31 of the inner conductor 30 is extended counterclockwise from the starting point 31*a* to the end point 31*b* along the circumferential direction of the outer conductor 10, in the top-down view of the mounting surface 2. Current flows in the inner conductor 30 from the starting point 31*a* toward the end point 31*b* along the circumferential direction of the circular portion 31. In other words, in the top-down view of the mounting surface 2, current flows counterclockwise in the inner conductor 30 from the starting point 31*a* connected to the first feed point 11 toward the end point 31*b* kept free from connection. The connection portion 32 connects the starting point 31*a* of the circular portion 31 and the first feed point 11 of the outer conductor 10. The connection portion 32 is extended along the radial direction of the outer conductor 10.

Figure 2:
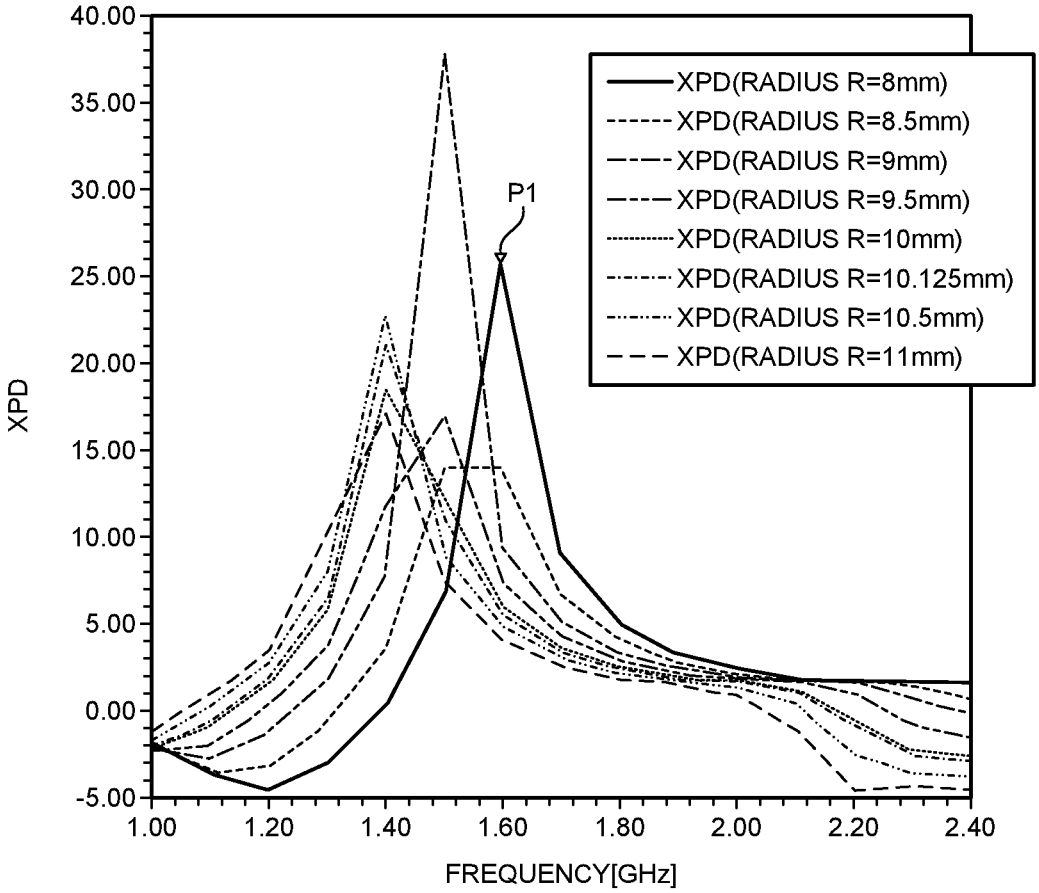
FIG. 2 is a graph of cross-polarization discrimination (XPD) of the antenna according to the first embodiment.
Figure 3:
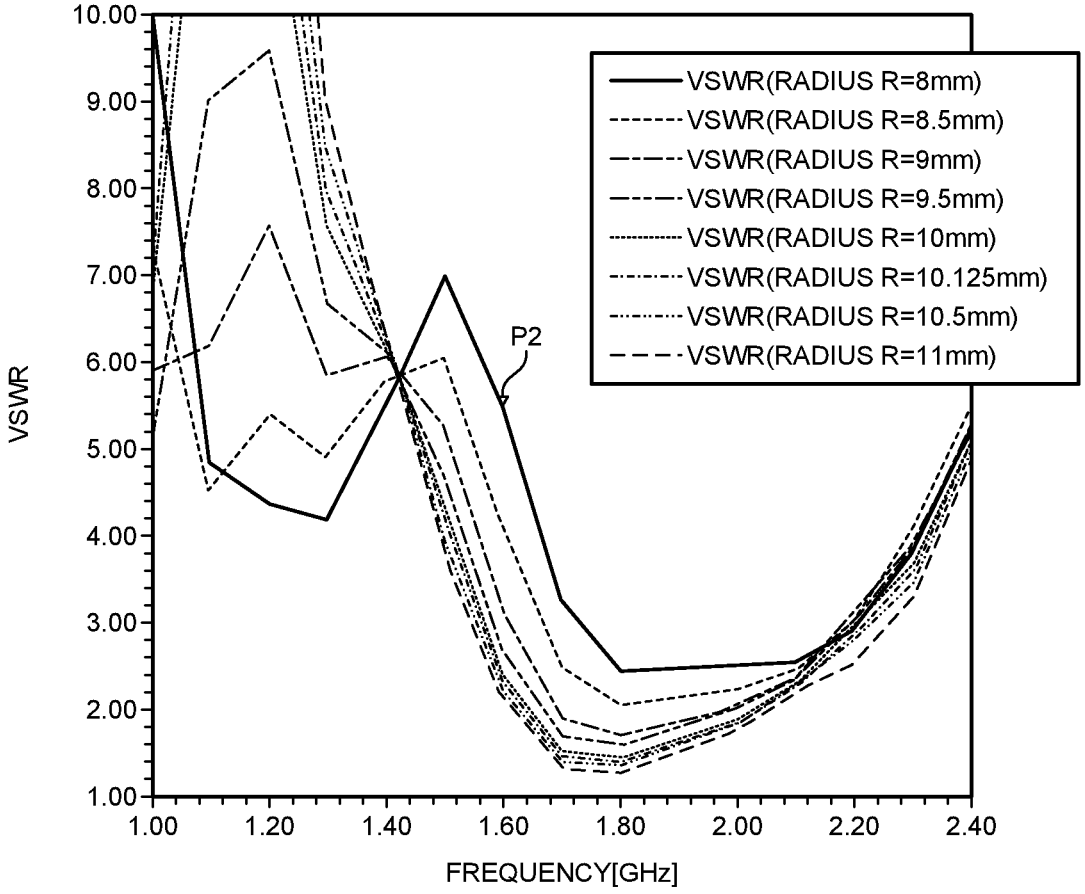
FIG. 3 is a graph of the voltage standing wave ratio (VSWR) of the antenna according to the first embodiment.
Figure 4:
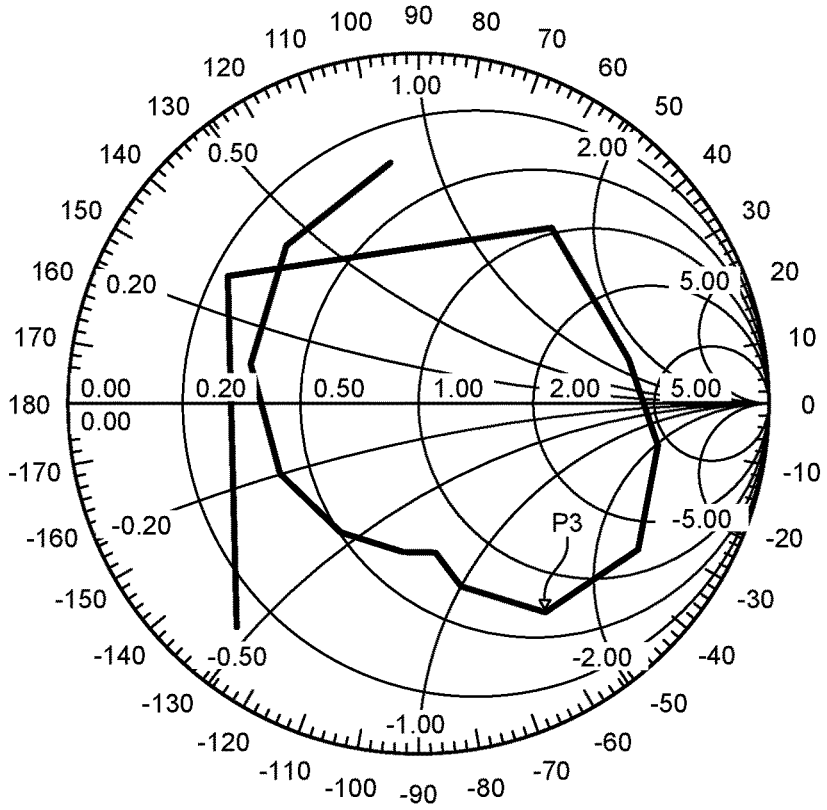
FIG. 4 is a Smith chart that illustrates the characteristic impedance of the antenna according to the first embodiment.
Figure 5:
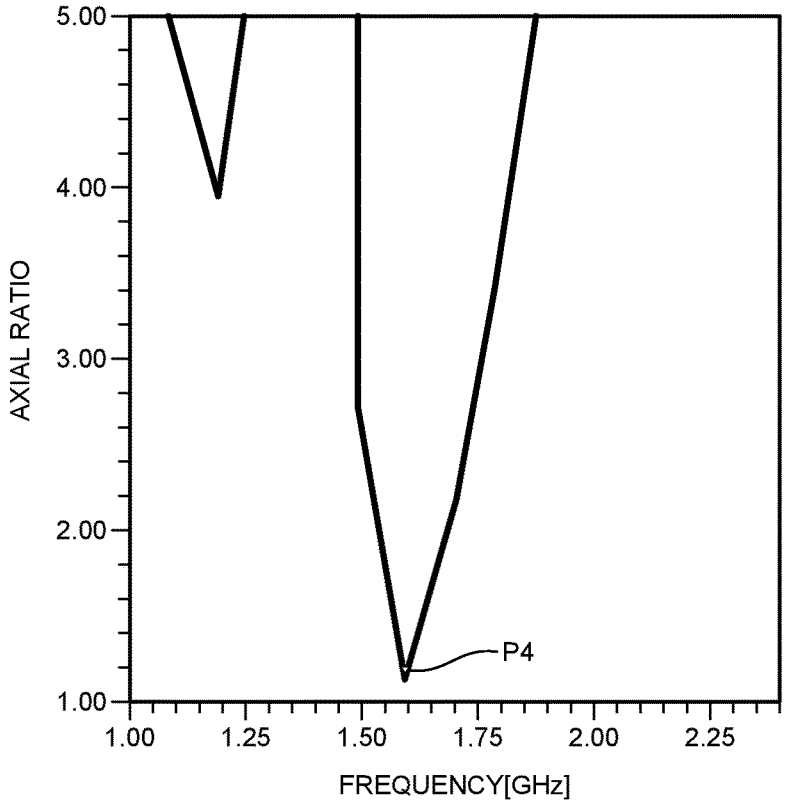
FIG. 5 is a graph of the axial ratio of the antenna according to the first embodiment.
Figure 6:
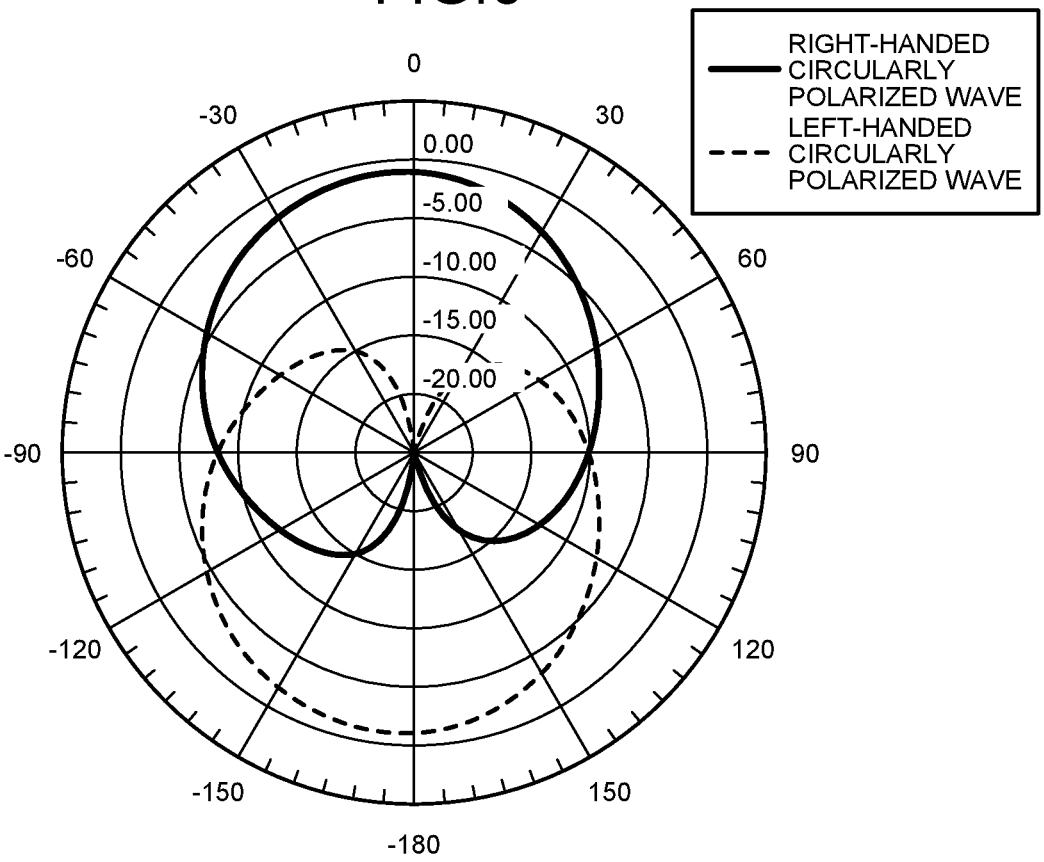
FIG. 6 is a chart that illustrates directivity of the antenna according to the first embodiment.

Simulations have been conducted on the antenna 1 of the first embodiment, and the results of the simulations will now be described. In the first embodiment, the antenna 1 for the simulations was prepared by printing 1-mm width patterns of the antenna 1 on a 0.25-mm thick PET film using 0.01-mm thick silver paste and arranging the resulting film between 0.1-mm thick PET films in the vertical direction. The permittivity of the PET film is "3", and the connection portion 32 for connecting the inner conductor 30 and the outer conductor 10 has a length of 1 mm. FIG. 2 is a graph of values of cross polarization discrimination (XPD) of the antenna 1 of when the radius R of the inner conductor 30 is changed from 8 mm to 11 mm at intervals of approximately 0.5 mm. In FIG. 2, the y-axis represents the XPD value, and the x-axis represents the frequency. In FIG. 2, the simulations demonstrate that the antenna 1 has the largest XPD value, approximately 25 dB (P1 in the graph), at a frequency of 1.6 GHz in use of the inner conductor 30 having a radius R of 8 mm. The result indicates that the gain of the left-handed circularly polarized wave is low. FIG. 3 is a graph of the voltage standing wave ratio (VSWR) of the antenna 1 of when the radius R of the inner conductor 30 is changed from 8 mm to 11 mm at intervals of approximately 0.5 mm. In FIG. 3, the y-axis represents the VSWR, and the x-axis represents the frequency. In FIG. 3, the simulations demonstrate that the antenna 1 has a VSWR of approximately 5.6 (P2 in the graph) at a frequency of 1.6 GHz, in use of the inner conductor 30 having a radius R of 8 mm. The result indicates that the electrical efficiency is relatively low. FIG. 4 is a Smith chart that illustrates the characteristic impedance of when the inner conductor 30 has a radius R of 8 mm. In FIG. 4, the simulation using the inner conductor 30 having an 8-mm radius R demonstrates that the antenna 1 has a magnitude of reflection of approximately 0.69 and a phase of approximately −58 (P3 in the graph) at a frequency of 1.6 GHz. The results indicate that reflection is relatively large. FIG. 5 is a graph of the axial ratio (AR) of when the inner conductor 30 has a radius R of 8 mm. In FIG. 5, the y-axis represents the axial ratio, and the x-axis represents the frequency. In FIG. 5, the simulation using the inner conductor 30 having an 8-mm radius R demonstrates that the antenna 1 has an axial ratio of approximately 1.1 dB (P4 in the graph) at a frequency of 1.6 GHz. The result indicates that the axial ratio is good. FIG. 6 is a chart that illustrates directivity of when the inner conductor 30 has a radius R of 8 mm. In FIG. 6, the simulation using the inner conductor 30 having an 8-mm radius R demonstrates that a right-handed circularly polarized wave and a left-handed circularly polarized wave are symmetrical to each other and that there is a symmetry in directivity between the circularly polarized waves. The symmetry allows the outer conductor 10 to receive the left-handed circularly polarized wave with the antenna 1 turned over. In receiving the left-handed circularly polarized wave, the inner conductor 30 has the circular portion 31 extended clockwise from the starting point 31*a* to the end point 31*b*, in the top-down view of the mounting surface 2.

As described above, the antenna 1 according to the first embodiment includes the outer conductor 10 and the inner conductor 30. The outer conductor 10 is formed of the first linear conductor having a length corresponding to one wavelength of the right-handed circularly polarized wave and circularly extended from the first feed point 11 to the second feed point 12. Current flows between the first feed point 11 and the second feed point 12. The inner conductor 30 is disposed inside the outer conductor 10, and is formed of the second linear conductor. The second linear conductor is another conductor different from the first linear conductor and has a length determined based on one wavelength of the left-handed circularly polarized wave. The second linear conductor of the inner conductor 30 has the starting point 31*a* connected to the first feed point 11 and has the end point 31*b* kept free from connection at a location inside the outer conductor 10. The inner conductor 30 has a circular portion 31 as a curved portion curvedly formed between the starting point 31*a* and the end point 31*b* and is designed such that current flows in a direction opposite to the current flow in the outer conductor 10.

With the antenna 1 configured as above, current of the right-handed circularly polarized wave flows into the outer conductor 10, and current of the left-handed circularly polarized wave flows into the inner conductor 30. The antenna 1 configured as above can keep current of the left-handed circularly polarized wave from flowing into the outer conductor 10. This flow control of the antenna 1 can increase the gain of the right-handed circularly polarized wave. Consequently, the antenna 1 can improve XPD and properly receive the right-handed circularly polarized wave. The circular shape of the outer conductor 10 of the antenna 1 is advantageous in acquiring good values of the axial ratio, which represents the roundness of the right-handed circularly polarized wave. The antenna 1 is produced, for example, by printing the first and the second linear conductors. The method can reduce the number of production processes and thus reduce the cost of production compared with a conventional method of assembling the antenna 1. Since there is no necessity of using a member (fixing stay) to fix the antenna 1, as used for a conventional antenna, the method of printing is beneficial in reducing the number of components of the antenna 1. Furthermore, the antenna 1 is thinner and more flexible than a conventional patch antenna, which can increase conformability of the antenna 1 to the place of installation. For example, the antenna 1 can be installed inside the roof of a vehicle.

The above antenna 1 has the outer conductor 10 and the inner conductor 30 mounted on the mounting surface 2. The outer conductor 10 receives a right-handed circularly polarized wave with the inner conductor 30 extended counterclockwise from the starting point 31*a* to the end point 31*b*, in the top-down view of the mounting surface 2. The antenna 1 configured as above allows current of a left-handed circularly polarized wave to flow into the inner conductor 30 while keeping the current from flowing into the outer conductor 10. This structure can improve XPD.

The inner conductor 30 of the antenna 1 has a circularly formed circular portion 31 as the curved portion. The antenna 1 configured as above allows current of a left-handed circularly polarized wave to flow into the circular portion 31 of the inner conductor 30 while keeping the current from flowing into the outer conductor 10. This structure can improve XPD.

First Modification of First Embodiment

Figure 7:
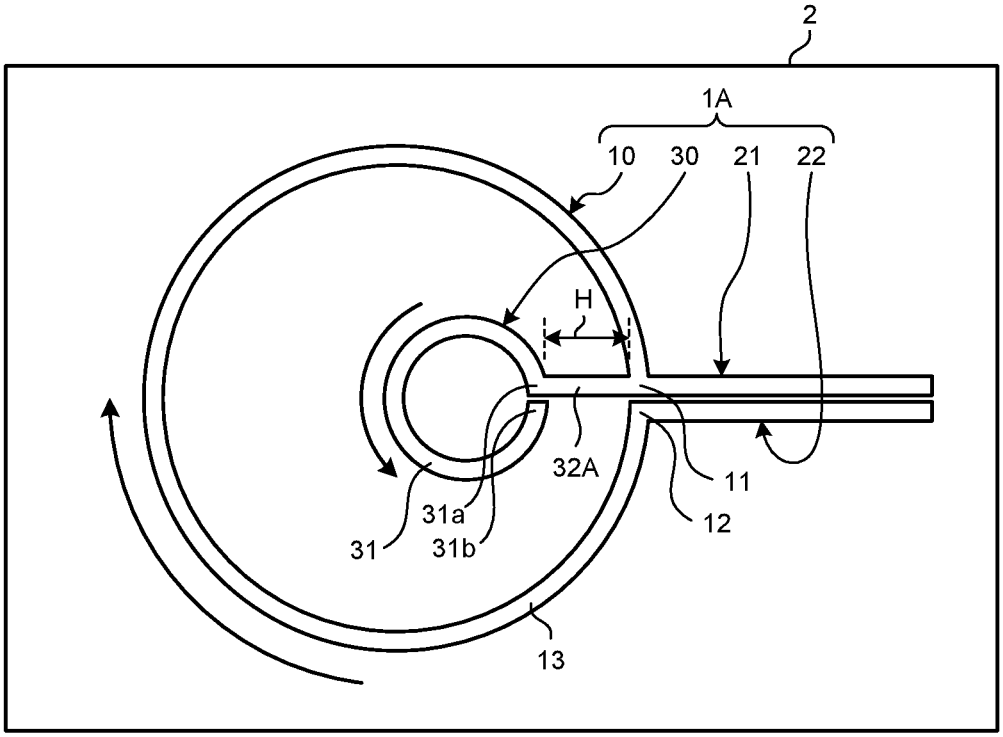
FIG. 7 is a front view of an example configuration of an antenna according to a first modification of the first embodiment.
Figure 8:
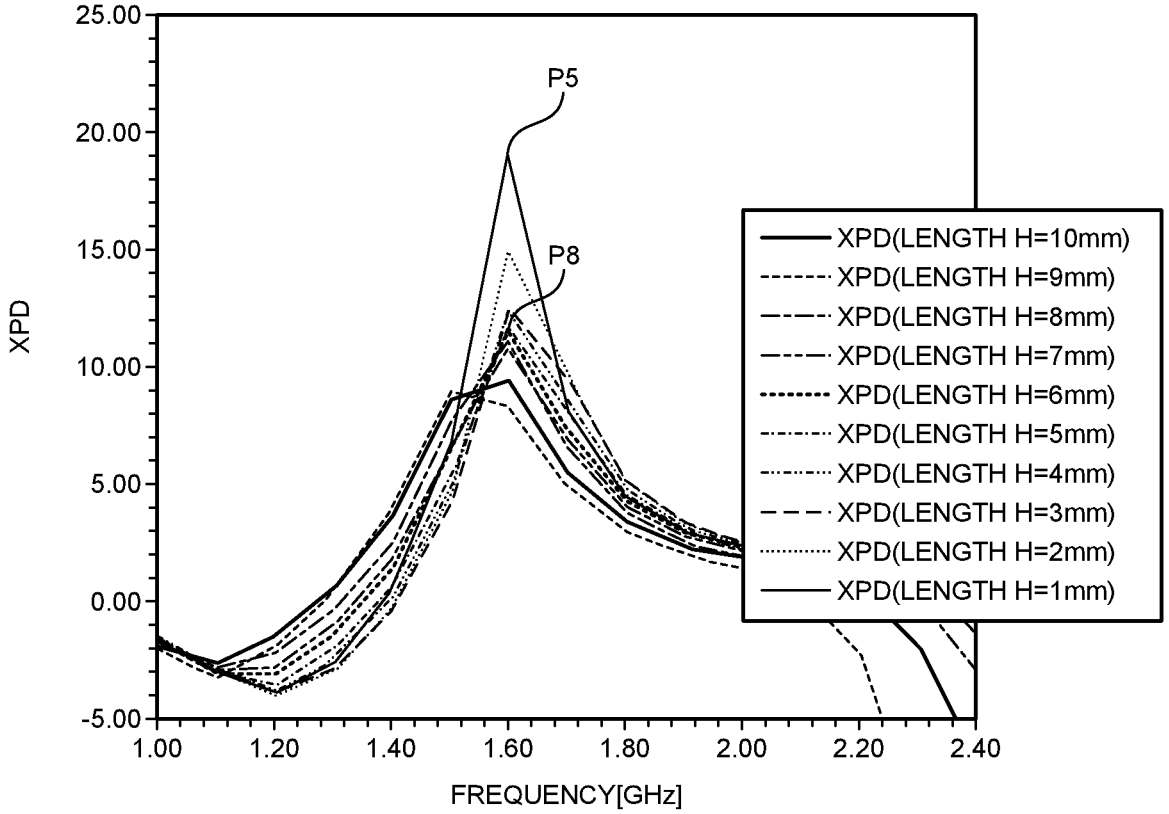
FIG. 8 is a graph of XPD values of the antenna according to the first modification of the first embodiment.
Figure 9:
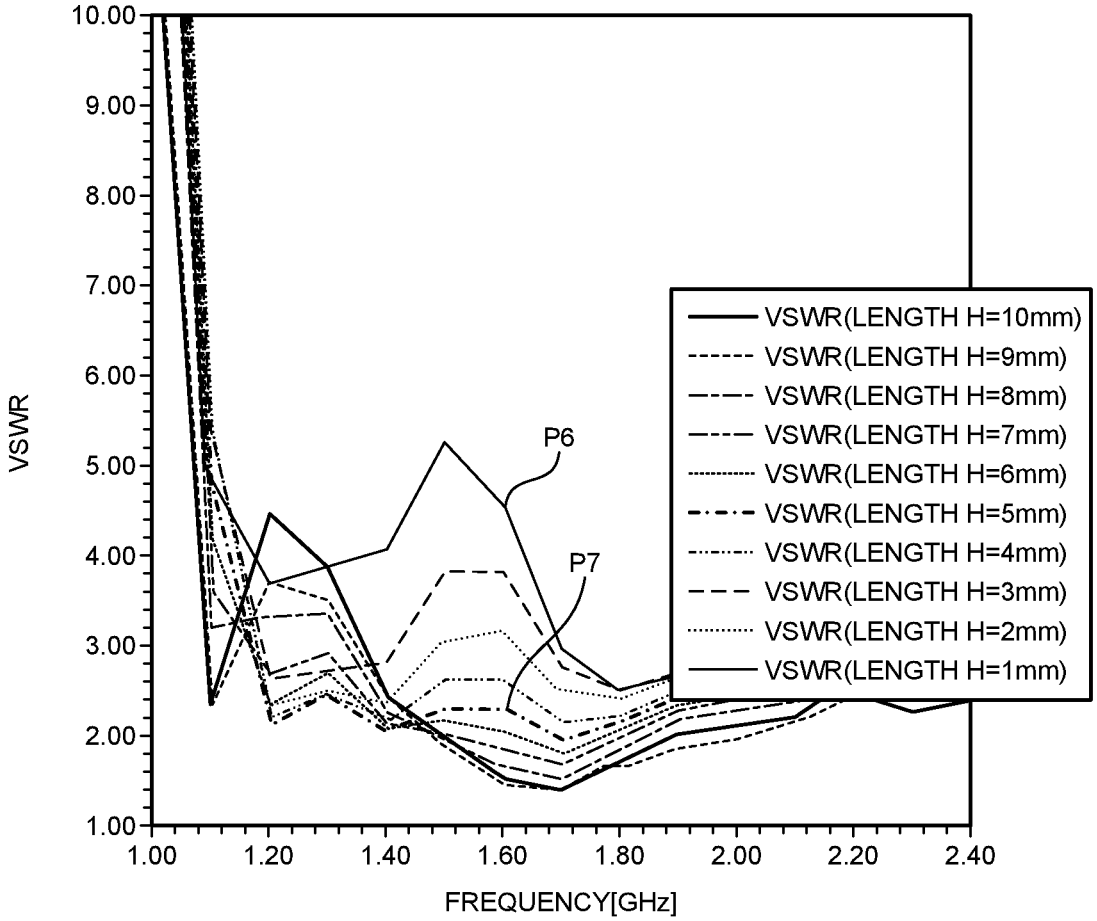
FIG. 9 is a graph of the VSWR of the antenna according to the first modification of the first embodiment.
Figure 10:
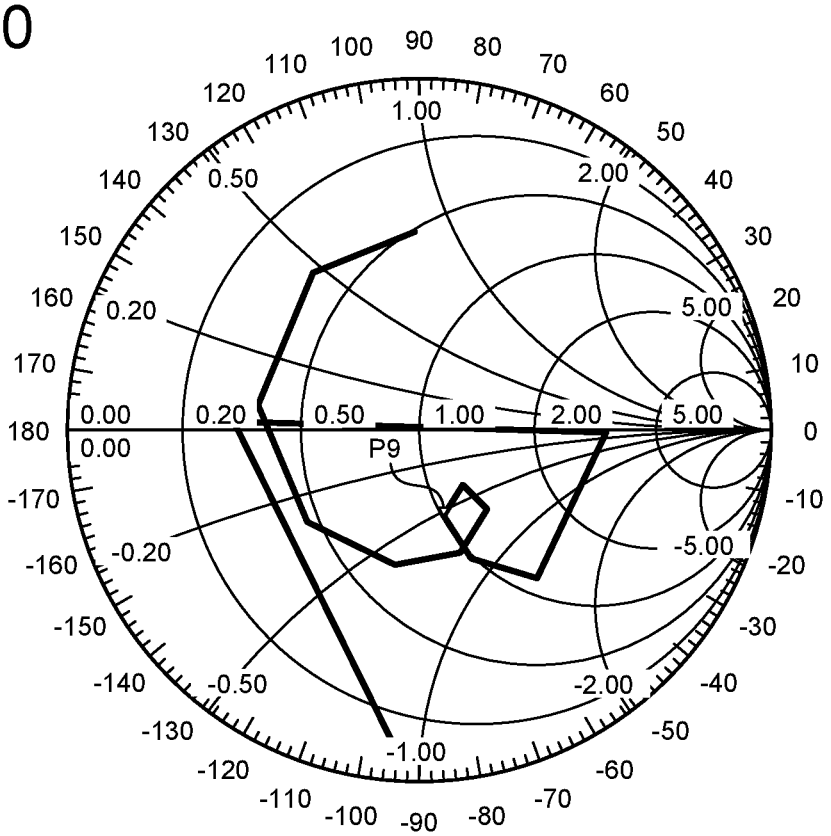
FIG. 10 is a Smith chart that illustrates the characteristic impedance of the antenna according to the first modification of the first embodiment.
Figure 11:
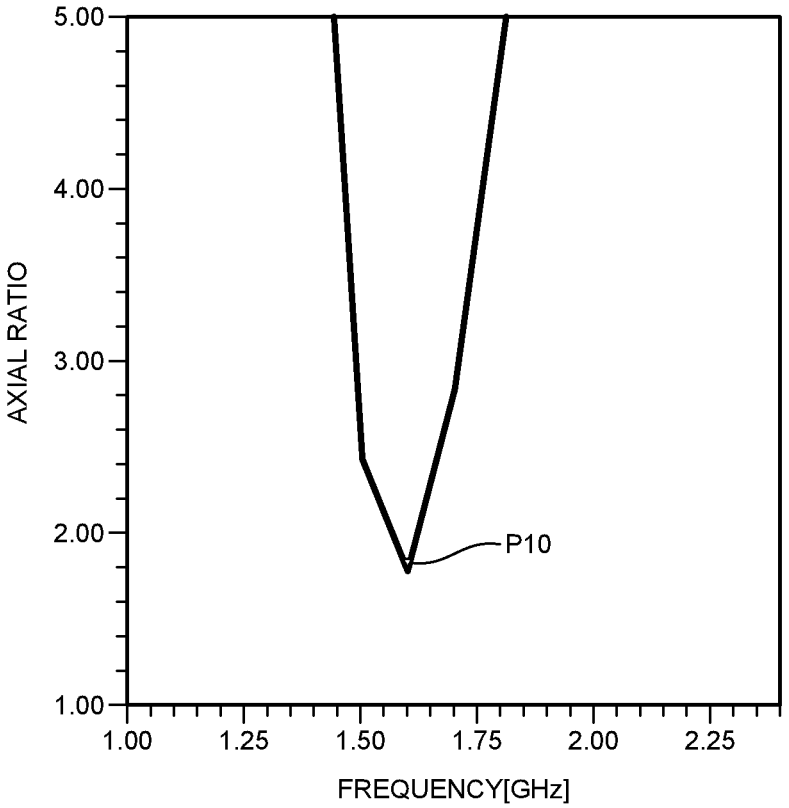
FIG. 11 is a graph of the axial ratio of the antenna according to the first modification of the first embodiment.
Figure 12:
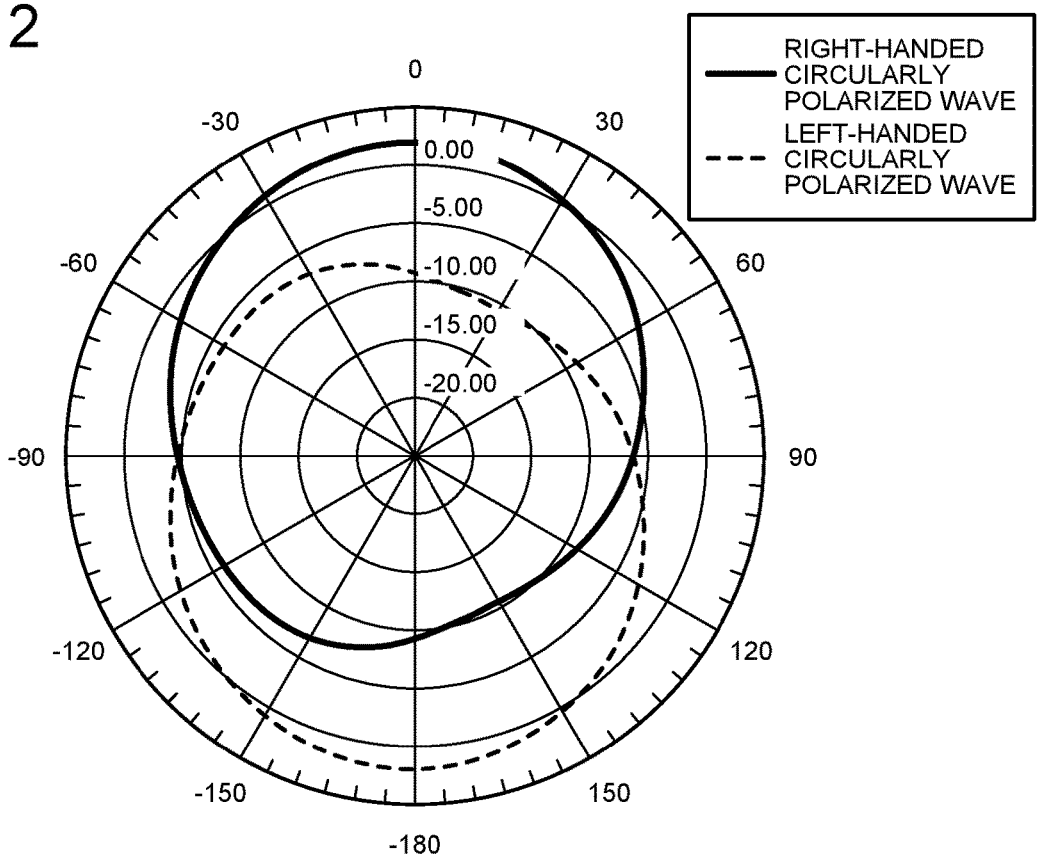
FIG. 12 is a chart that illustrates directivity of the antenna according to the first modification of the first embodiment.

An antenna 1A according to a first modification of the first embodiment will now be described. In the first modification, like reference numerals indicate like components of the first embodiment, and detailed description thereof will be omitted. The antenna 1A of the first modification is different from the antenna of the first embodiment in that a length H of a connection portion 32A, connecting the inner conductor 30 and the outer conductor 10, is changed from 1 mm to 10 mm at intervals of 1 mm. Compared to the antenna 1 of the first embodiment, the antenna 1A is configured such that the inner conductor 30 is located closer to the center of the outer conductor 10 by a distance consistent with an increase in the length of the connection portion 32A from 1 mm to 10 mm along the radial direction. FIG. 7 is a drawing of the antenna 1A of when the connection portion 32A has a length H of 8 mm. FIG. 8 is a graph of XPD values of the antenna 1A of when the length H of the connection portion 32A is changed from 1 mm to 10 mm at intervals of 1 mm. In FIG. 8, the y-axis represents the XPD value, and the x-axis represents the frequency. In FIG. 8, the simulations demonstrate that the antenna 1A has the largest XPD value, approximately 19 dB (P5 in the graph), at a frequency of 1.6 GHz, in use of the connection portion 32A having a length H of 1 mm. The result indicates that the gain of the left-handed circularly polarized wave is low. FIG. 9 is a graph of the VSWR of the antenna 1A of when the length H of the connection portion 32A is changed from 1 mm to 10 mm at intervals of 1 mm. In FIG. 9, the y-axis represents the VSWR, and the x-axis represents the frequency. In FIG. 9, the simulations demonstrate that the antenna 1A has a VSWR of approximately 4.5 (P6 in the graph) at a frequency of 1.6 GHz, in use of the connection portion 32A having a length H of 1 mm. The result indicates that the electrical efficiency is relatively low. At a frequency of 1.6 GHz and a length H of the connection portion 32A of 8 mm, the VSWR is approximately 2.0 (P7 in the graph), which indicates that the electrical efficiency is relatively high, and XPD has a relatively good value, approximately 11.5 dB (P8 in the graph). These results indicate that the antenna 1A is well balanced when the length H of the connection portion 32A is 8 mm. FIG. 10 is a Smith chart that illustrates the characteristic impedance of when the connection portion 32A has a length H of 8 mm. In FIG. 10, the simulation using the connection portion 32A having an 8-mm length H demonstrates that the magnitude of reflection is approximately 0.2 and the phase is approximately −74 (P9 in the graph) at a frequency of 1.6 GHz. The results indicate that reflection is relatively small compared with the antenna 1 of the first embodiment. FIG. 11 is a graph of the axial ratio in use of the connection portion 32A having a length H of 8 mm. In FIG. 11, the y-axis represents the axial ratio, and the x-axis represents the frequency. In FIG. 11, the simulation using the connection portion 32A having an 8-mm length H demonstrates that the antenna 1A has an axial ratio of approximately 1.8 dB (P10 in the graph) at a frequency of 1.6 GHz. The result indicates that the axial ratio is worse than that of the antenna 1 of the first embodiment. FIG. 12 is a chart that illustrates directivity of when the connection portion 32A has a length H of 8 mm. In FIG. 12, the simulation using the connection portion 32A having an 8-mm length H demonstrates that the right-handed circularly polarized wave and the left-handed circularly polarized wave are symmetrical to each other and that there is a symmetry in directivity between the circularly polarized waves. The symmetry allows the outer conductor 10 to receive the left-handed circularly polarized wave with the antenna 1A turned over. In receiving the left-handed circularly polarized wave, the inner conductor 30 has the circular portion 31 extended clockwise from the starting point 31*a* to the end point 31*b*, in the top-down view of the mounting surface 2.

As described above, the antenna 1A according to the first modification of the first embodiment includes the outer conductor 10 having a length corresponding to one wavelength of the right-handed circularly polarized wave of a GPS and includes the inner conductor 30 having a length determined based on one wavelength of the left-handed circularly polarized wave of the GPS and consisting of the circular portion 31 and the connection portion 32A. The connection portion 32A of the antenna 1A has a length H of 8 mm. The above configuration allows the antenna 1A to have a smaller VSWR than that of the antenna 1 of the first embodiment, which means that higher electrical efficiency is achieved with the antenna 1A than with the antenna 1 of the first embodiment. Although the value of XPD of the antenna 1A is smaller than that of the antenna 1 of the first embodiment, the value 11.5 dB is satisfactory to exert balanced performance of the antenna 1A. Furthermore, the antenna 1A has a symmetry in directivity, which allows the outer conductor 10 to receive the left-handed circularly polarized wave with the antenna 1A turned over.

Second Modification of First Embodiment

Figure 13:
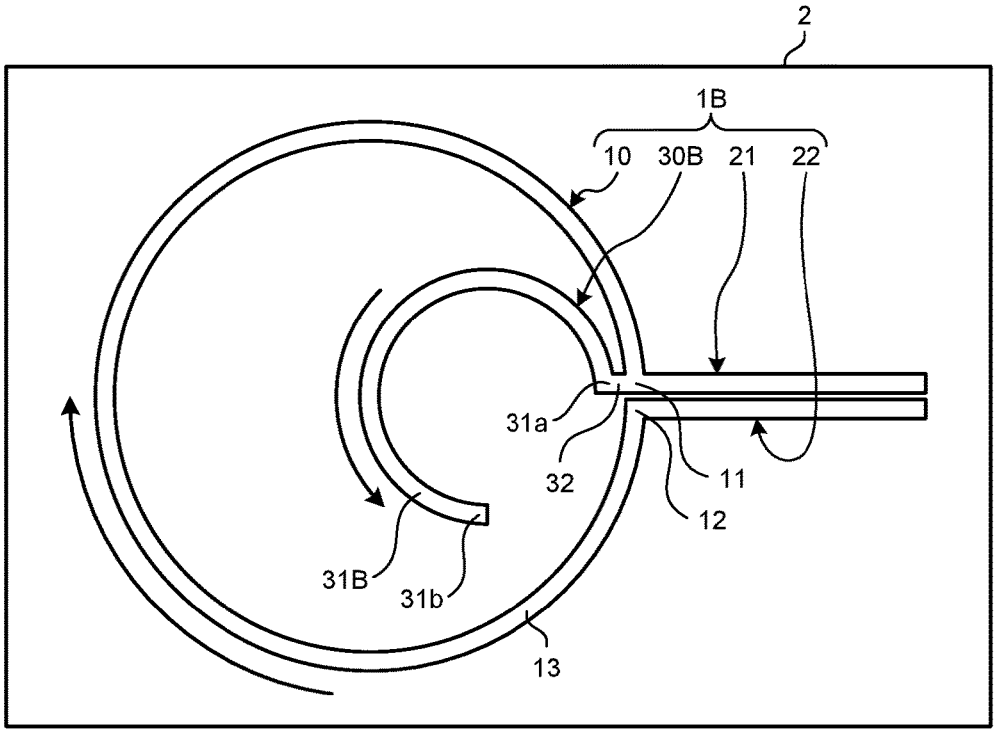
FIG. 13 is a front view of an example configuration of an antenna according to a second modification of the first embodiment.

An antenna 1B according to a second modification of the first embodiment will now be described. In the second modification, like reference numerals indicate like components of the first embodiment and the first modification, and detailed description thereof will be omitted. As illustrated in FIG. 13, the inner conductor 30B of the second modification is different from the inner conductors of the first embodiment and the first modification in that the circular portion 31 of the first embodiment is replaced by a C-shaped arcuate portion 31B. The arcuate portion 31B has the starting point 31*a* of the second linear conductor connected to the first feed point 11 as the negative electrode through the connection portion 32 and has the end point 31*b* of the second linear conductor kept free from connection at a location inside the outer conductor 10. As described above, the second linear conductor has a length, for example, determined based on one wavelength of the left-handed circularly polarized wave of a GPS. The inner conductor 30B is designed such that current flows in a direction opposite to the current flow in the outer conductor 10. Specifically, the arcuate portion 31B of the inner conductor 30B is extended counterclockwise from the starting point 31*a* to the end point 31*b* along the circumferential direction of the outer conductor 10, in the top-down view of the mounting surface 2. With the radius of the outer conductor 10 defined as r, the arcuate portion 31B of the inner conductor 30B has a radius of ½ r and has a circumference of ¾ πr. The inner conductor 30B has the center located at a distance of ¼ r from the first feed point 11. Current flows in the inner conductor 30B from the starting point 31*a* toward the end point 31*b* along the circumferential direction of the arcuate portion 31B. In other words, in the top-down view of the mounting surface 2, current flows in the inner conductor 30B counterclockwise from the starting point 31*a* connected to the first feed point 11 toward the end point 31*b* kept free from connection. The connection portion 32 connects the starting point 31*a* of the arcuate portion 31B and the first feed point 11 of the outer conductor 10. The connection portion 32 is extended along the radial direction of the outer conductor 10.

Figure 14:
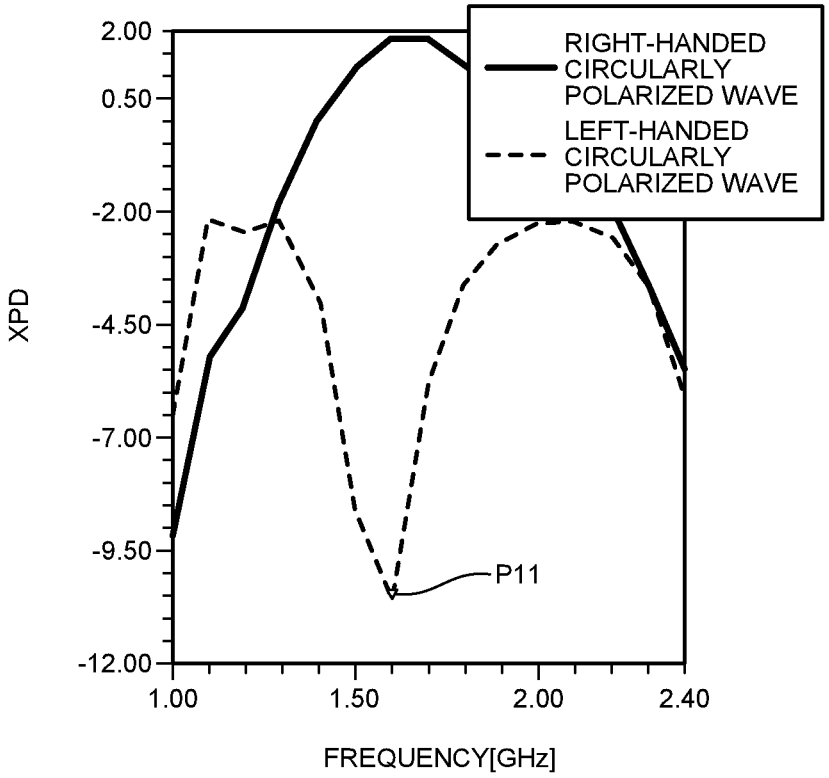
FIG. 14 is a graph of XPD values of the antenna according to the second modification of the first embodiment.
Figure 15:
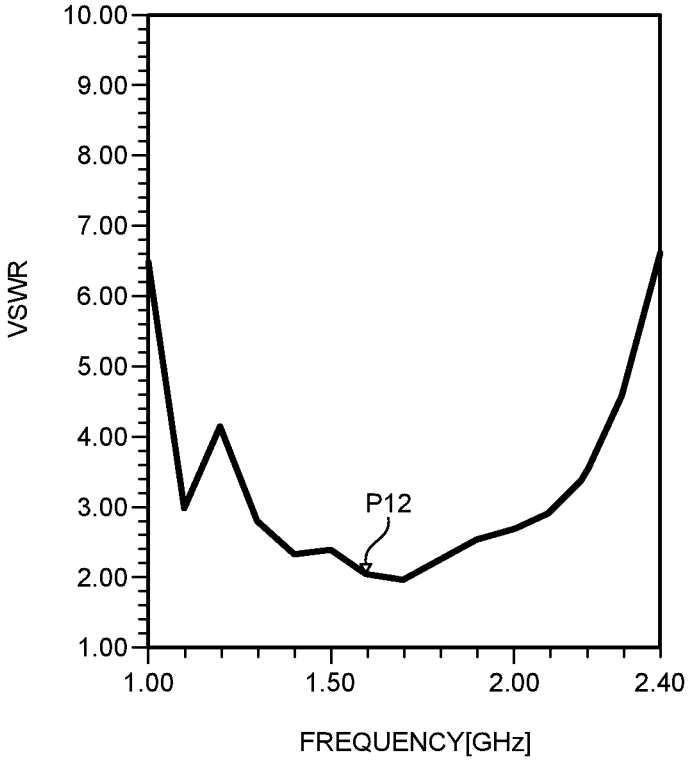
FIG. 15 is a graph of the VSWR of the antenna according to the second modification of the first embodiment.
Figure 16:
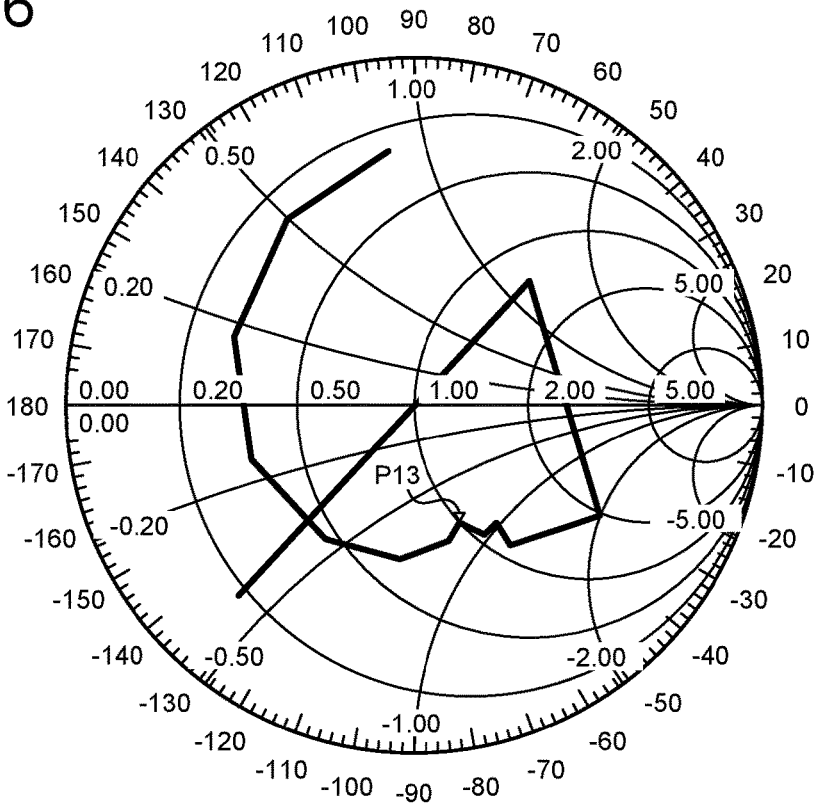
FIG. 16 is a Smith chart that illustrates the characteristic impedance of the antenna according to the second modification of the first embodiment.
Figure 17:
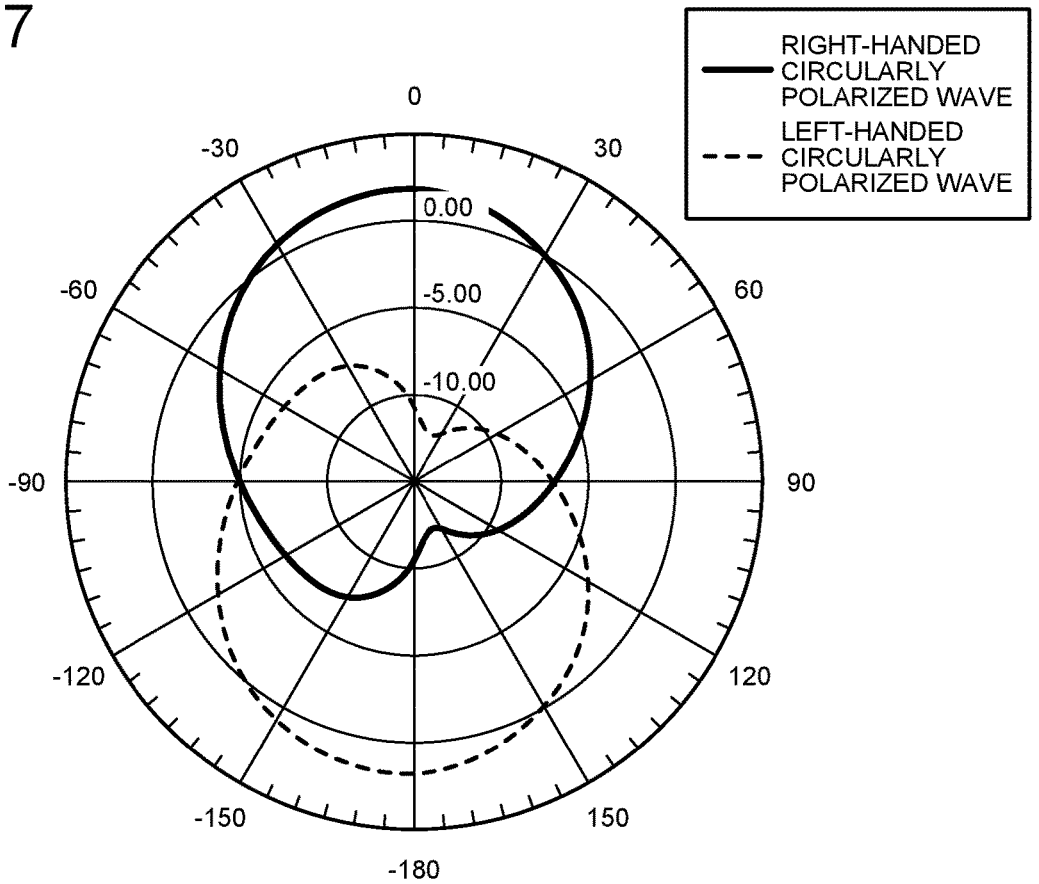
FIG. 17 is a chart that illustrates directivity of the antenna according to the second modification of the first embodiment.

Simulations with the antenna 1B of the second modification of the first embodiment demonstrate the following results. FIG. 14 is a graph of XPD values of the antenna 1B. In FIG. 14, the y-axis represents the XPD value, and the x-axis represents the frequency. In FIG. 14, the simulation demonstrates that the antenna 1B has a value of XPD of approximately 12 dB (P11 in the graph), at a frequency of 1.6 GHz. The result indicates that the gain of the left-handed circularly polarized wave is low. FIG. 15 is a graph of the VSWR of the antenna 1B. In FIG. 15, the y-axis represents the VSWR, and the x-axis represents the frequency. In FIG. 15, the simulation demonstrates that the antenna 1B has a VSWR of approximately 2.0 (P12 in the graph) at a frequency of 1.6 GHz. The result indicates that the electrical efficiency is relatively high. FIG. 16 is a Smith chart that illustrates the characteristic impedance. In FIG. 16, the simulation demonstrates that the magnitude of reflection is approximately 0.35 and the phase is approximately −70 (P13 in the graph) at a frequency of 1.6 GHz. The results indicate that reflection is relatively small. FIG. 17 is a chart that illustrates directivity. In FIG. 17, the simulation demonstrates that the right-handed circularly polarized wave and the left-handed circularly polarized wave are symmetrical to each other and that there is a symmetry in directivity between the circularly polarized waves. The symmetry allows the outer conductor 10 to receive the left-handed circularly polarized wave with the antenna 1B turned over. In receiving the left-handed circularly polarized wave, the inner conductor 30B has the arcuate portion 31B extended clockwise from the starting point 31*a* to the end point 31*b*, in the top-down view of the mounting surface 2.

As described above, the antenna 1B according to the second modification of the first embodiment includes the outer conductor 10 having a length corresponding to one wavelength of a right-handed circularly polarized wave of a GPS and includes the inner conductor 30B having a length determined based on one wavelength of a left-handed circularly polarized wave of the GPS and consisting of the arcuate portion 31B and the connection portion 32. The antenna 1B configured as above is allowed to decrease the gain of the left-handed circularly polarized wave and to increase the electrical efficiency. Furthermore, the antenna 1B has a symmetry in directivity, which allows the outer conductor 10 to receive the left-handed circularly polarized wave with the antenna 1B turned over.

Third Modification of First Embodiment

Figure 18:
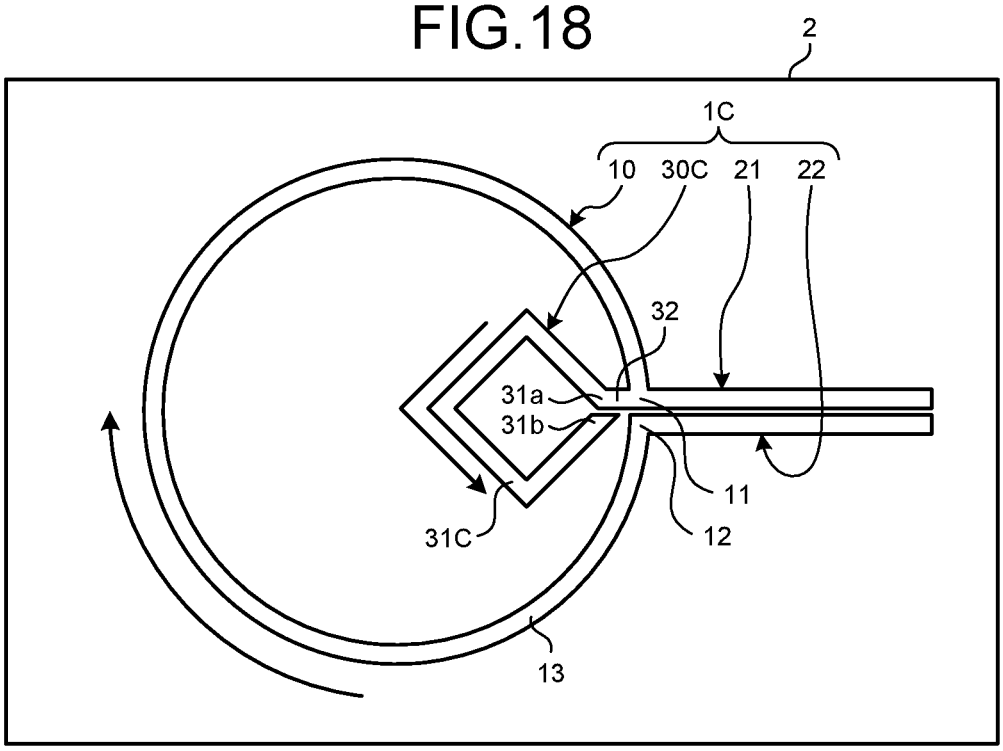
FIG. 18 is a front view of an example configuration of an antenna according to a third modification of the first embodiment.

An antenna 1C according to a third modification of the first embodiment will now be described. In the third modification, like reference numerals indicate like components of the first embodiment, the first modification, and the second modification, and detailed description thereof will be omitted. As illustrated in FIG. 18, an inner conductor 30C of the third modification is different from the inner conductors of the first embodiment and others in that the circular portion 31 of the first embodiment is replaced by a rectangularly formed rectangular portion 31C. The rectangular portion 31C is an example of the curved portion, and the shape is, for example, square (rhomboid). The rectangular portion 31C has the starting point 31*a* of the second linear conductor connected to the first feed point 11 as the negative electrode through the connection portion 32 and has the end point 31*b* of the second linear conductor kept free from connection at a location inside the outer conductor 10. As described above, the second linear conductor has a length, for example, determined based on one wavelength of the left-handed circularly polarized wave of a GPS. The rectangular portion 31C has a gap between the starting point 31*a* and the end point 31*b*. The inner conductor 30C is designed such that current flows in a direction opposite to the current flow in the outer conductor 10. Specifically, the rectangular portion 31C of the inner conductor 30C is extended counterclockwise from the starting point 31*a* to the end point 31*b* along the circumferential direction of the outer conductor 10, in the top-down view of the mounting surface 2. Current flows in the inner conductor 30C from the starting point 31*a* toward the end point 31*b* along the circumferential direction of the rectangular portion 31C. In other words, in the top-down view of the mounting surface 2, current flows in the inner conductor 30C counterclockwise from the starting point 31*a* connected to the first feed point 11 toward the end point 31*b* kept free from connection. The connection portion 32 connects the starting point 31*a* of the rectangular portion 31C and the first feed point 11 of the outer conductor 10. The connection portion 32 is extended along the radial direction of the outer conductor 10.

Figure 19:
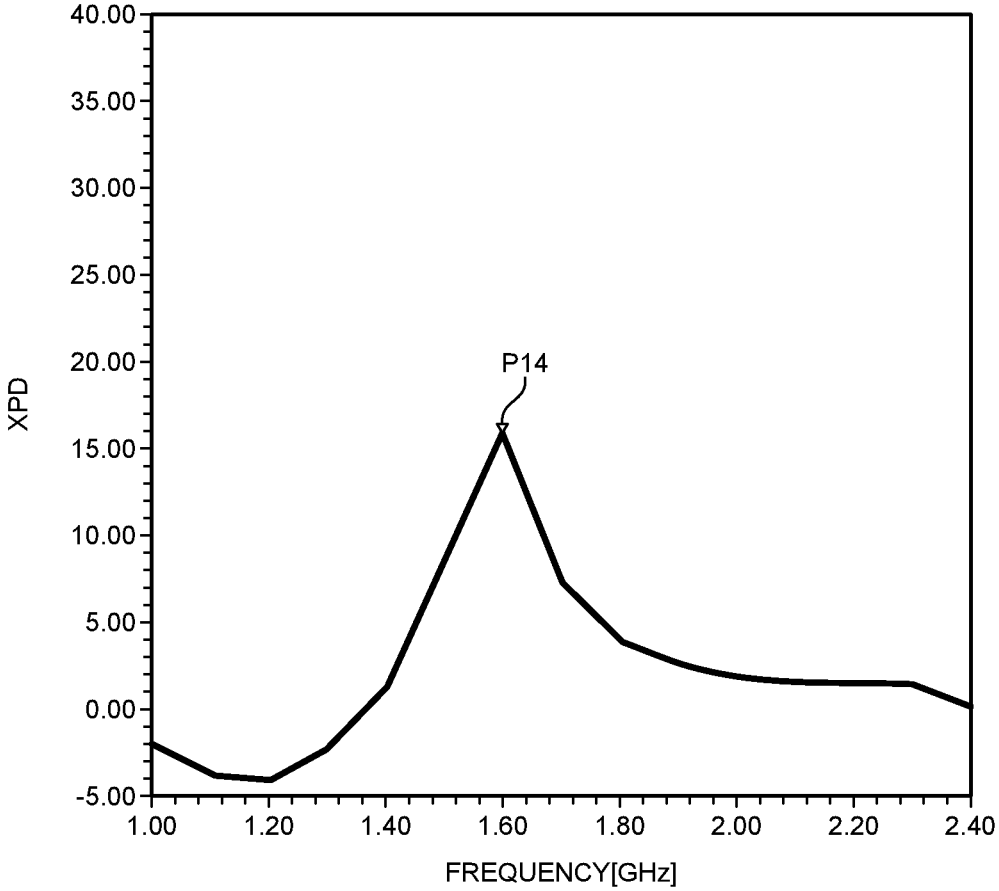
FIG. 19 is a graph of XPD values of the antenna according to the third modification of the first embodiment.
Figure 20:
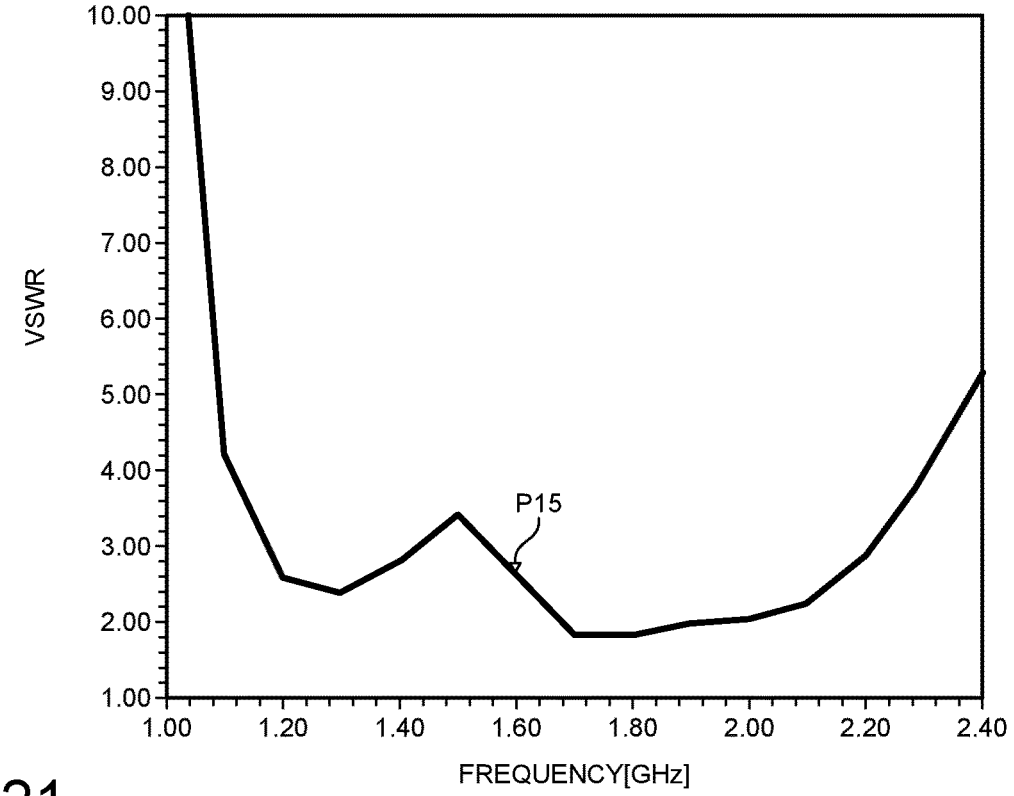
FIG. 20 is a graph of the VSWR of the antenna according to the third modification of the first embodiment.
Figure 21:
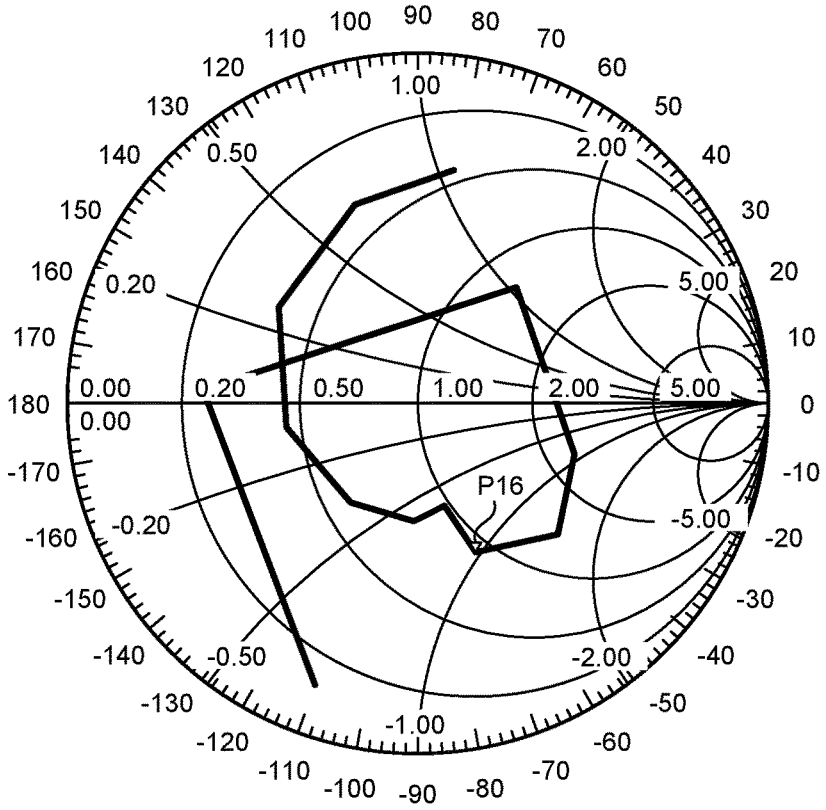
FIG. 21 is a Smith chart that illustrates the characteristic impedance of the antenna according to the third modification of the first embodiment.
Figure 22:
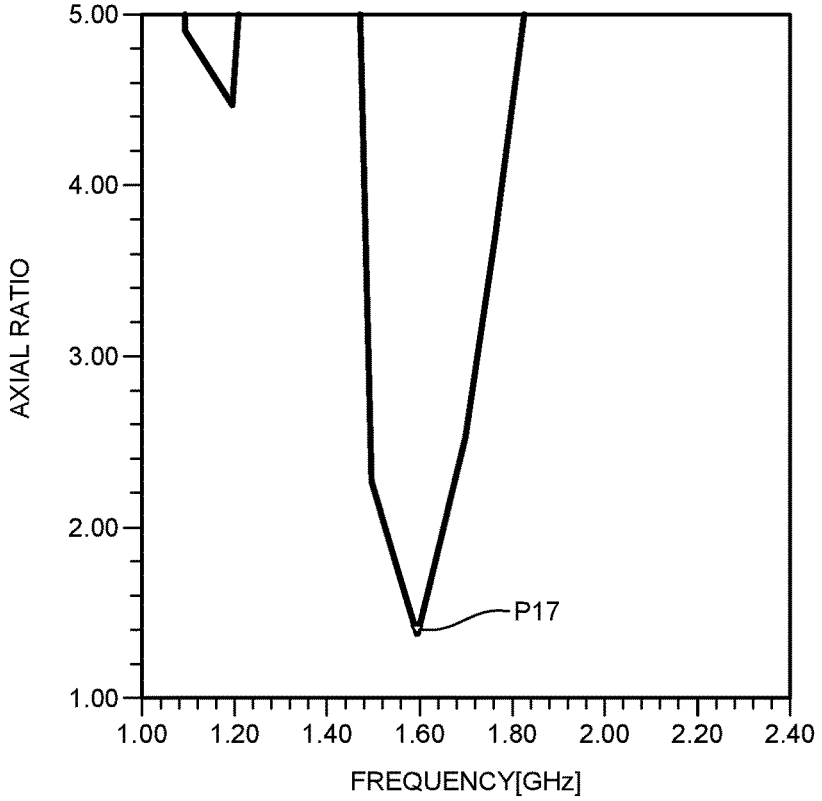
FIG. 22 is a graph of the axial ratio of the antenna according to the third modification of the first embodiment.
Figure 23:
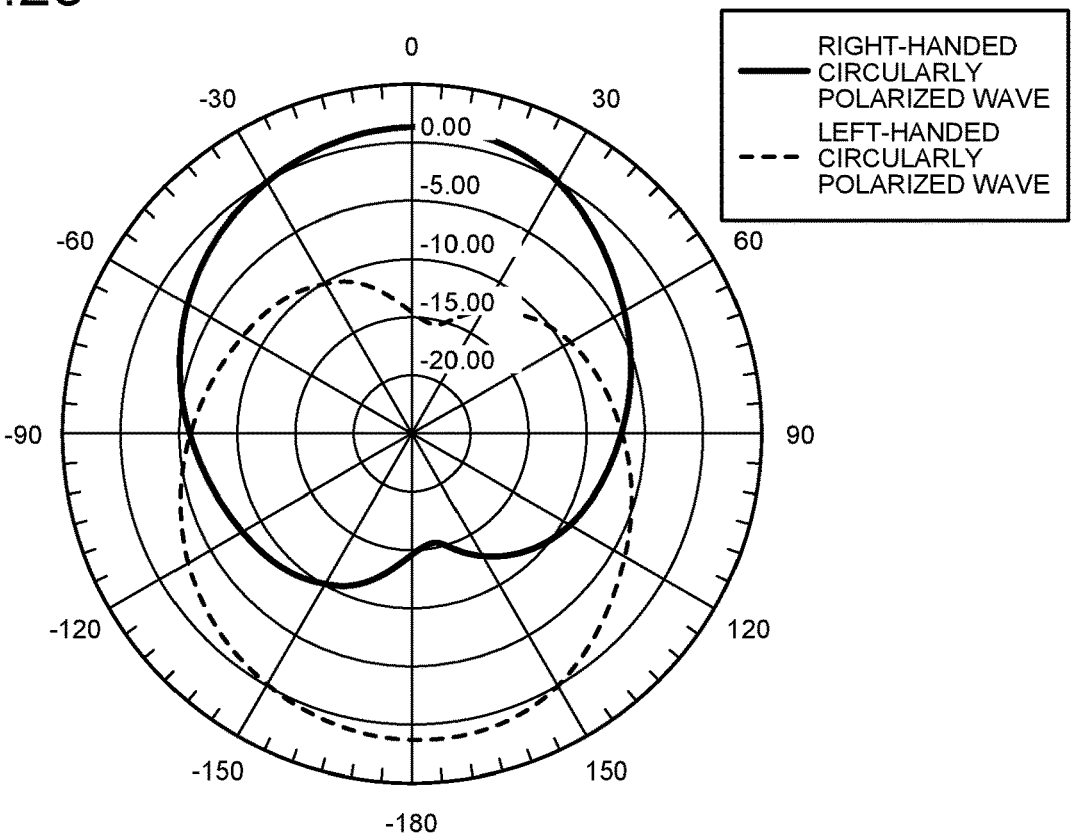
FIG. 23 is a chart that illustrates directivity of the antenna according to the third modification of the first embodiment.

Simulations with the antenna 1C of the third modification of the first embodiment demonstrate the following results. FIG. 19 is a graph of XPD values of the antenna 1C. In FIG. 19, the y-axis represents the XPD value, and the x-axis represents the frequency. In FIG. 19, the simulation demonstrates that the antenna 1C has a value of XPD of approximately 16 dB (P14 in the graph), at a frequency of 1.6 GHz. The result indicates that the gain of the left-handed circularly polarized wave is low. FIG. 20 is a graph of the VSWR of the antenna 1C. In FIG. 20, the y-axis represents the VSWR, and the x-axis represents the frequency. In FIG. 20, the simulation demonstrates that the antenna 1C has a VSWR of approximately 2.6 (P15 in the graph), at a frequency of 1.6 GHz. The result indicates that reflection is relatively small. FIG. 21 is a Smith chart that illustrates the characteristic impedance. In FIG. 21, the simulation demonstrates that the magnitude of reflection is approximately 0.45 and the phase is approximately −69 (P16 in the graph) at a frequency of 1.6 GHz. The results indicate that reflection is relatively small. FIG. 22 is a graph of the axial ratio. In FIG. 22, the y-axis represents the axial ratio, and the x-axis represents the frequency. In FIG. 22, the simulation demonstrates that the antenna 1C has an axial ratio of approximately 1.4 dB (P17 in the graph) at a frequency of 1.6 GHz. The result indicates that the axial ratio is relatively good. FIG. 23 is a chart that illustrates directivity. In FIG. 23, the simulation demonstrates that the right-handed circularly polarized wave and the left-handed circularly polarized wave are symmetrical to each other and that there is a symmetry in directivity between the circularly polarized waves. The symmetry allows the outer conductor 10 to receive the left-handed circularly polarized wave with the antenna 1C turned over. In receiving the left-handed circularly polarized wave, the inner conductor 30C has the rectangular portion 31C extended clockwise from the starting point 31*a* to the end point 31*b*, in the top-down view of the mounting surface 2.

As described above, the antenna 1C according to the third modification of the first embodiment includes the outer conductor 10 having a length corresponding to one wavelength of a right-handed circularly polarized wave of a GPS and includes the inner conductor 30C having a length determined based on one wavelength of a left-handed circularly polarized wave of the GPS and consisting of the rectangular portion 31C and the connection portion 32. The antenna 1C configured as above is allowed to decrease the gain of the left-handed circularly polarized wave and to increase the electrical efficiency. Furthermore, the antenna 1C has a symmetry in directivity, which allows the outer conductor 10 to receive the left-handed circularly polarized wave with the antenna 1C turned over.

Fourth Modification of First Embodiment

Figure 24:
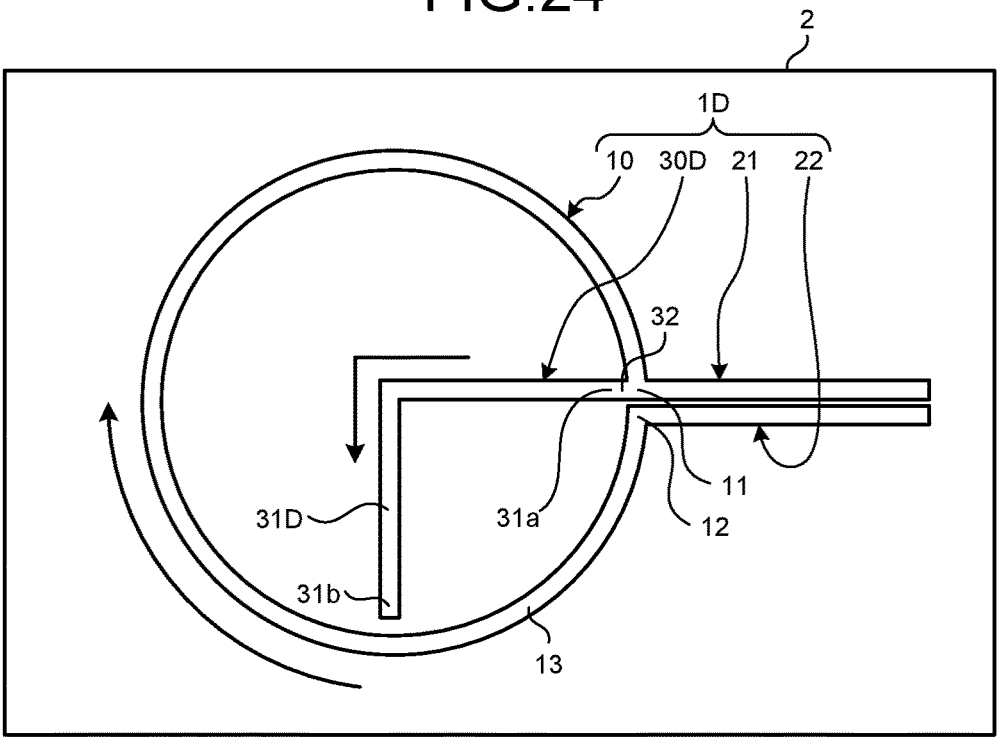
FIG. 24 is a front view of an example configuration of an antenna according to a fourth modification of the first embodiment.

An antenna 1D according to a fourth modification of the first embodiment will now be described. In the fourth modification, like reference numerals indicate like components of the first embodiment, the first modification, the second modification, and the third modification, and detailed description thereof will be omitted. As illustrated in FIG. 24, an inner conductor 30D of the fourth modification is different from the inner conductors of the first embodiment and others in that the circular portion 31 of the first embodiment is replaced by an L-shaped portion 31D formed in the shape of L. The L-shaped portion 31D is an example of the curved portion. The L-shaped portion 31D has the starting point 31*a* of the second linear conductor connected to the first feed point 11 as the negative electrode through the connection portion 32 and has the end point 31*b* of the second linear conductor kept free from connection at a location inside the outer conductor 10. As described above, the second linear conductor has a length, for example, determined based on one wavelength of the left-handed circularly polarized wave of a GPS. The inner conductor 30D is designed such that current flows in a direction opposite to the current flow in the outer conductor 10. Specifically, the L-shaped portion 31D of the inner conductor 30D is extended counterclockwise from the starting point 31*a* to the end point 31*b*, in the top-down view of the mounting surface 2. The L-shaped portion 31D, for example, has a first side with the starting point 31*a* extended along the radial direction of the outer conductor 10 to a substantial center of the outer conductor 10, and has a second side with the end point 31*b* extended at a substantially right angle to the first side. The first side and the second side of the L-shaped portion 31D have the same length. Current flows in the inner conductor 30D from the starting point 31*a* toward the end point 31*b* of the L-shaped portion 31D. In other words, in the top-down view of the mounting surface 2, current flows in the inner conductor 30D counterclockwise from the starting point 31*a* connected to the first feed point 11 toward the end point 31*b* kept free from connection. The connection portion 32 connects the starting point 31*a* of the L-shaped portion 31D and the first feed point 11 of the outer conductor 10. The connection portion 32 is extended along the radial direction of the outer conductor 10. In this configuration, the connection portion 32 is an end of the first side closer to the starting point 31*a* in the direction in which the first side is extended.

Figure 25:
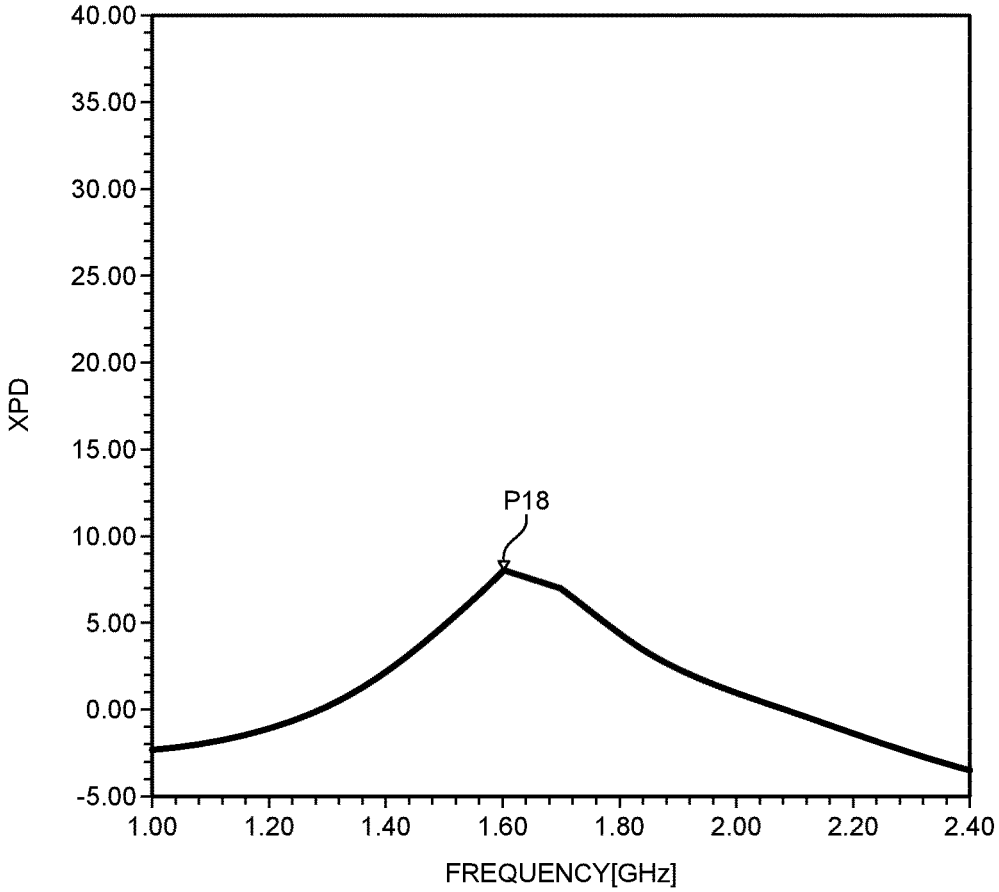
FIG. 25 is a graph of XPD values of the antenna according to the fourth modification of the first embodiment.
Figure 26:
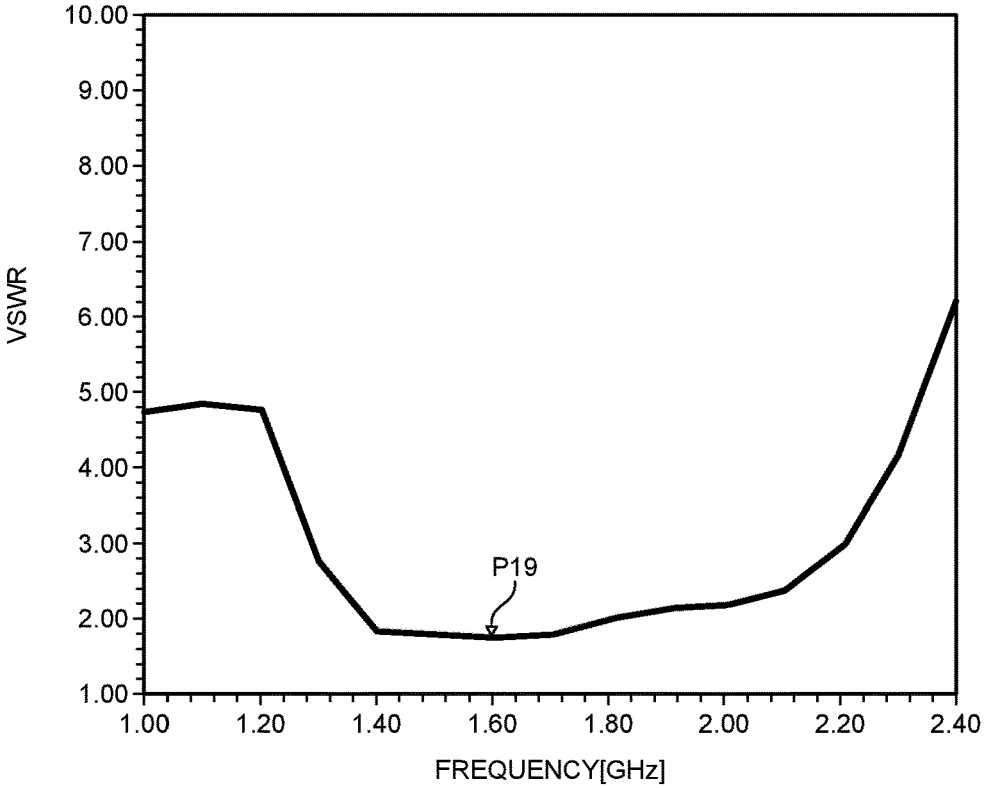
FIG. 26 is a graph of the VSWR of the antenna according to the fourth modification of the first embodiment.
Figure 27:
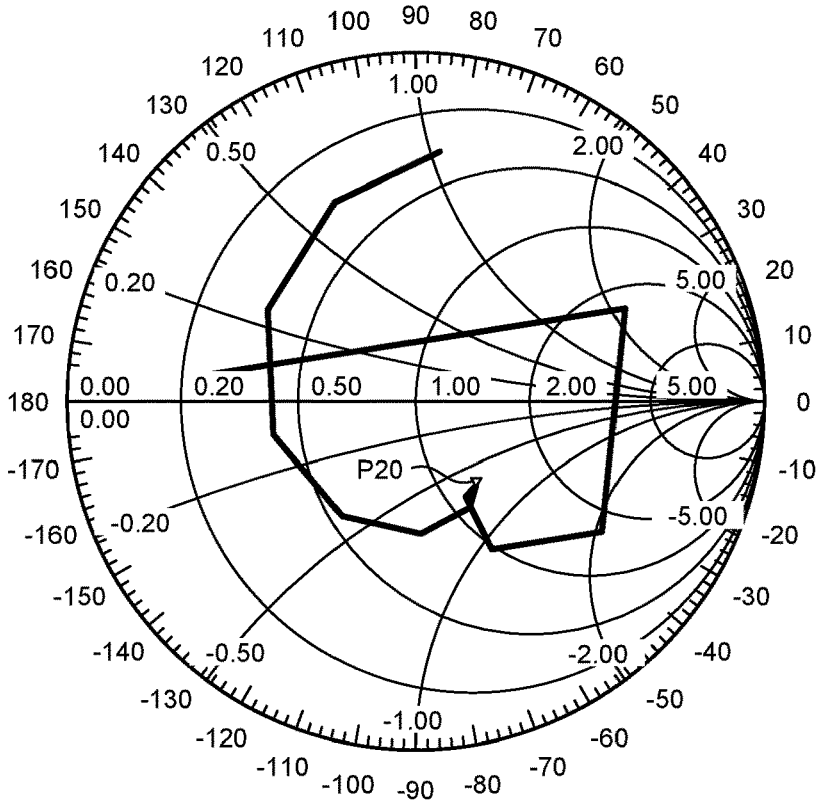
FIG. 27 is a Smith chart that illustrates the characteristic impedance of the antenna according to the fourth modification of the first embodiment.
Figure 28:
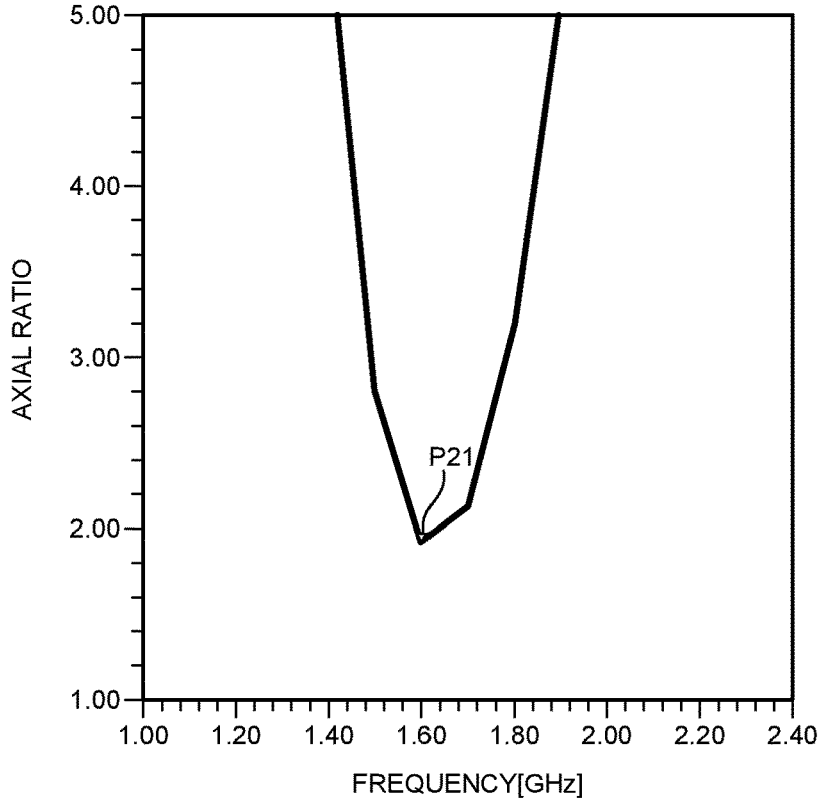
FIG. 28 is a graph of the axial ratio of the antenna according to the fourth modification of the first embodiment.
Figure 29:
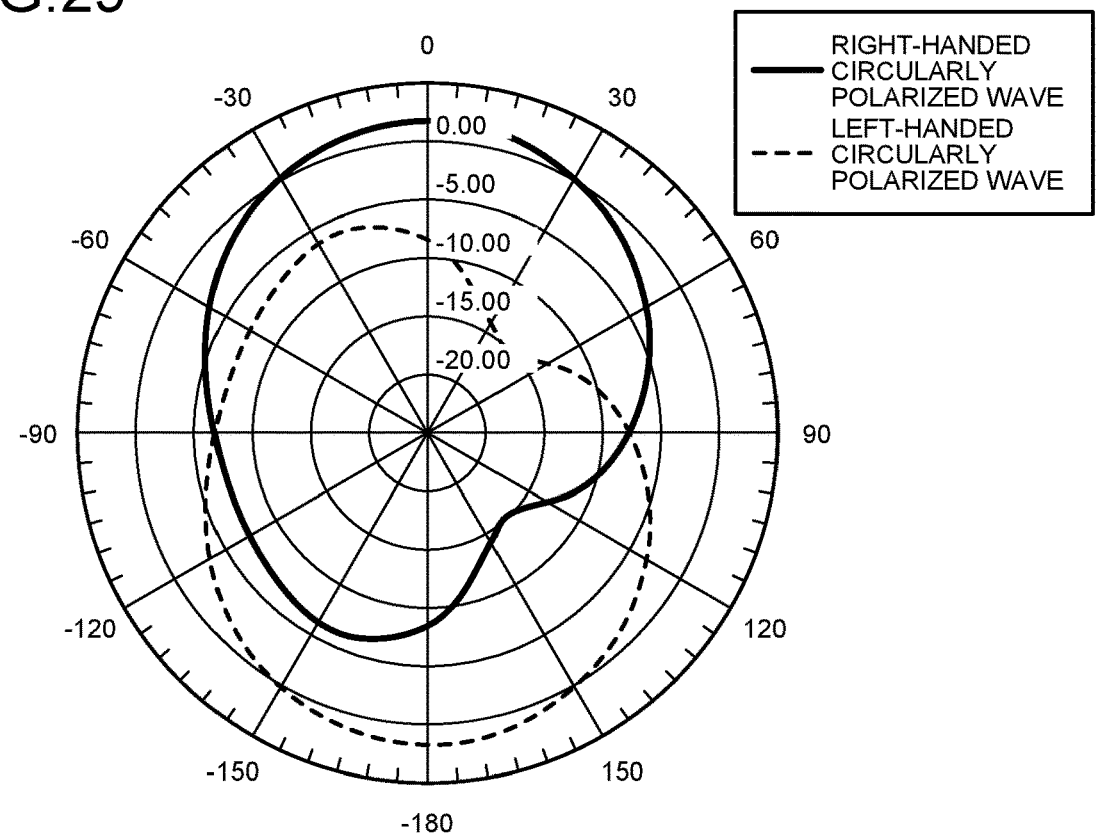
FIG. 29 is a chart that illustrates directivity of the antenna according to the fourth modification of the first embodiment.

Simulations with the antenna 1D of the fourth modification of the first embodiment demonstrate the following results. FIG. 25 is a graph of XPD values of the antenna 1D. In FIG. 25, the y-axis represents the XPD value, and the x-axis represents the frequency. In FIG. 25, the simulation demonstrates that the antenna 1D has a value of XPD of approximately 10 dB (P18 in the graph), at a frequency of 1.6 GHz. The result indicates that the gain of the left-handed circularly polarized wave is low. FIG. 26 is a graph of the VSWR of the antenna 1D. In FIG. 26, the y-axis represents the VSWR, and the x-axis represents the frequency. In FIG. 26, the simulation demonstrates that the antenna 1D has a VSWR of approximately 1.8 (P19 in the graph) at a frequency of 1.6 GHz. The result indicates that reflection is relatively small. FIG. 27 is a Smith chart that illustrates the characteristic impedance. In FIG. 27, the simulation demonstrates that the magnitude of reflection is approximately 0.29 and the phase is approximately −54 (P20 in the graph) at a frequency of 1.6 GHz. The results indicate that reflection is relatively small. FIG. 28 is a graph of the axial ratio. In FIG. 28, the y-axis represents the axial ratio, and the x-axis represents the frequency. In FIG. 28, the simulation demonstrates that the antenna 1D has an axial ratio of approximately 1.9 dB (P21 in the graph) at a frequency of 1.6 GHz. The result indicates that the axial ratio is worse than that of the antenna 1 of the first embodiment. FIG. 29 is a chart that illustrates directivity. In FIG. 29, the simulation demonstrates that the right-handed circularly polarized wave and the left-handed circularly polarized wave are symmetrical to each other and that there is a symmetry in directivity between the circularly polarized waves. The symmetry allows the outer conductor 10 to receive the left-handed circularly polarized wave with the antenna 1D turned over. In receiving the left-handed circularly polarized wave, the inner conductor 30D has the L-shaped portion 31D extended clockwise from the starting point 31*a* to the end point 31*b*, in the top-down view of the mounting surface 2.

As described above, the antenna 1D according to the fourth modification of the first embodiment includes the outer conductor 10 having a length corresponding to one wavelength of a right-handed circularly polarized wave of a GPS and includes the inner conductor 30D having a length determined based on one wavelength of a left-handed circularly polarized wave of the GPS and consisting of the L-shaped portion 31D and the connection portion 32. The antenna 1D configured as above is allowed to decrease the gain of the left-handed circularly polarized wave and to increase the electrical efficiency. Furthermore, the antenna 1D has a symmetry in directivity, which allows the outer conductor 10 to receive the left-handed circularly polarized wave with the antenna 1D turned over.

Second Embodiment

Figure 30:
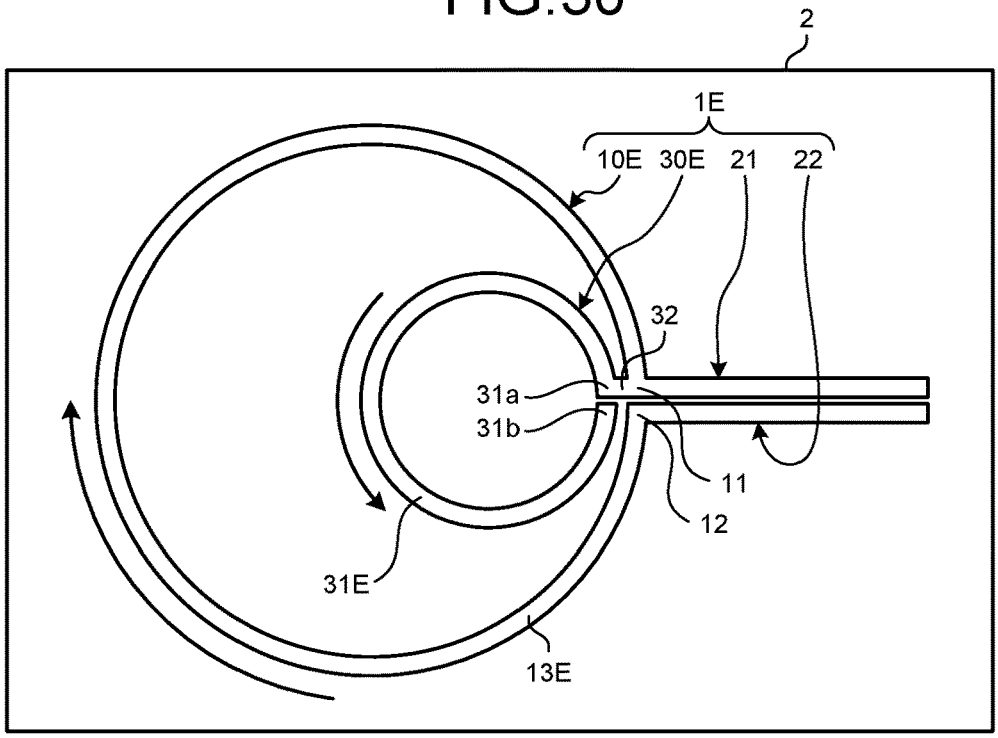
FIG. 30 is a front view of an example configuration of an antenna according to a second modification.

An antenna 1E according to a second embodiment will now be described. In the second embodiment, like reference numerals indicate like components of the first embodiment, the first modification, the second modification, the third modification, and the fourth modification, and detailed description thereof will be omitted. An inner conductor 30E of the second embodiment illustrated in FIG. 30 is different from the inner conductors of the first embodiment and others in receiving a right-handed circularly polarized wave of an ETC. The right-handed circularly polarized wave of an ETC has, for example, a frequency of 5.8 GHz. The antenna 1E of the second embodiment has the same shape as that of the antenna 1 of the first embodiment, and is smaller than the antenna 1 to receive radio waves having frequencies higher than the frequency of a GPS. The antenna 1E according to the second embodiment includes an outer conductor 10E, first and second feedlines 21 and 22, and the inner conductor 30E. The outer conductor 10E is an antenna to receive a right-handed circularly polarized wave of an ETC. The outer conductor 10E is mounted on the mounting surface 2 and includes a body 13E and a first feed point 11 provided at an end thereof and a second feed point 12 at the other end thereof. In the second embodiment, the first feed point 11 is the negative electrode and the second feed point 12 is the positive electrode. The body 13E is formed of the first linear conductor circularly extended from the first feed point 11 to the second feed point 12. The first linear conductor has a length corresponding to one wavelength of the right-handed circularly polarized wave of an ETC. The body 13E has a gap between the first feed point 11 and the second feed point 12. Current travels in the outer conductor 10E, between the first feed point 11 and the second feed point 12 along the circumferential direction of the body 13E. In the second embodiment, since the outer conductor 10E receives the right-handed circularly polarized wave of an ETC, current travels clockwise between the first feed point 11 and the second feed point 12 in the top-down view of the mounting surface 2.

The inner conductor 30E is used to control receipt of a left-handed circularly polarized wave. The inner conductor 30E is disposed on the mounting surface 2, inside the outer conductor 10E, and consists of a circular portion 31E and the connection portion 32. The circular portion 31E and the connection portion 32 are formed of the second linear conductor. The second linear conductor has a length, for example, determined based on one wavelength of the left-handed circularly polarized wave of an ETC. The circular portion 31E is circularly formed with the starting point 31*a* of the second linear conductor connected to the first feed point 11 as the negative electrode through the connection portion 32 and with the end point 31*b* of the second linear conductor kept free from connection at a location inside the outer conductor 10E. The circular portion 31E has a gap between the starting point 31*a* and the end point 31*b*. The inner conductor 30E is designed such that current flows in a direction opposite to the current flow in the outer conductor 10E. Specifically, the circular portion 31E of the inner conductor 30E is extended counterclockwise from the starting point 31*a* to the end point 31*b* along the circumferential direction of the outer conductor 10E, in the top-down view of the mounting surface 2. Current flows in the inner conductor 30E from the starting point 31*a* toward the end point 31*b* along the circumferential direction of the circular portion 31E. In other words, in the top-down view of the mounting surface 2, current flows in the inner conductor 30E counterclockwise from the starting point 31*a* connected to the first feed point 11 toward the end point 31*b* kept free from connection. The connection portion 32 connects the starting point 31*a* of the circular portion 31E and the first feed point 11 of the outer conductor 10E. The connection portion 32 is extended along the radial direction of the outer conductor 10E.

Figure 31:
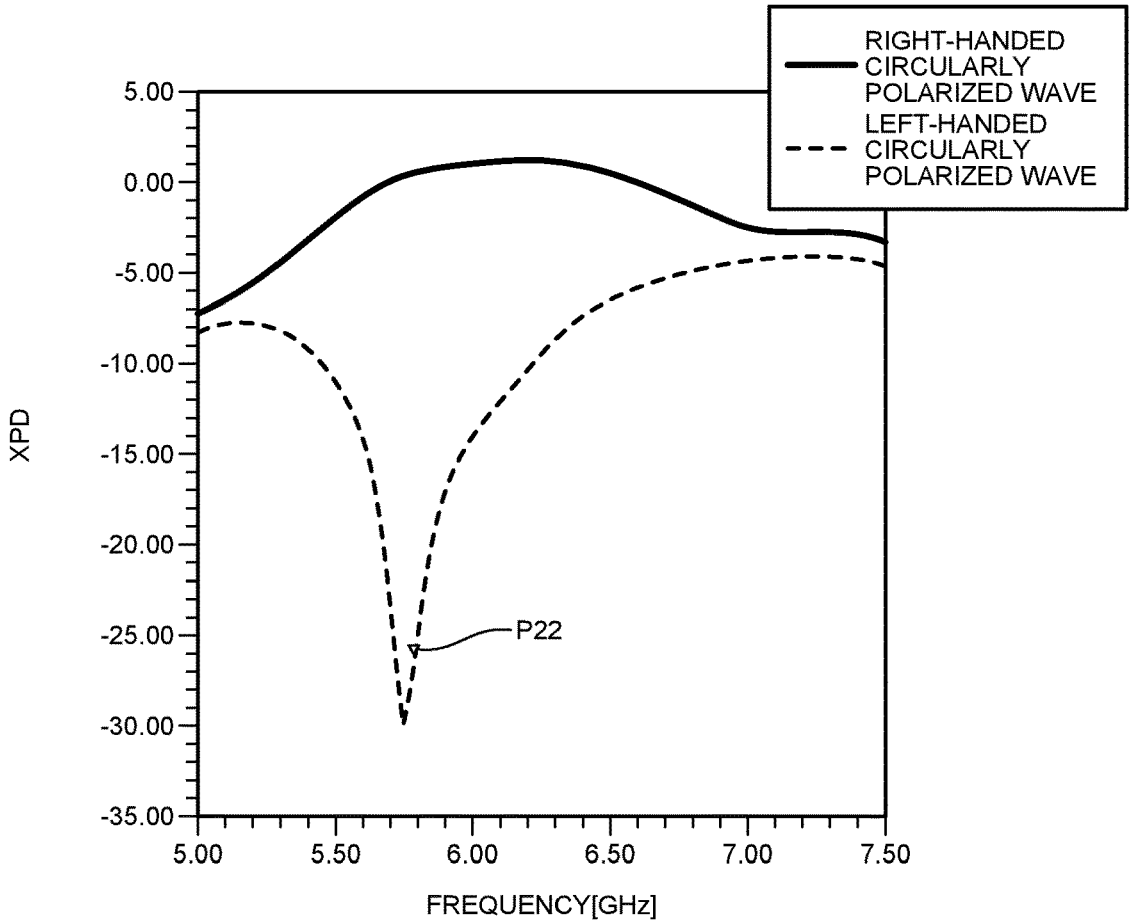
FIG. 31 is a graph of XPD values of the antenna according to the second embodiment.
Figure 32:
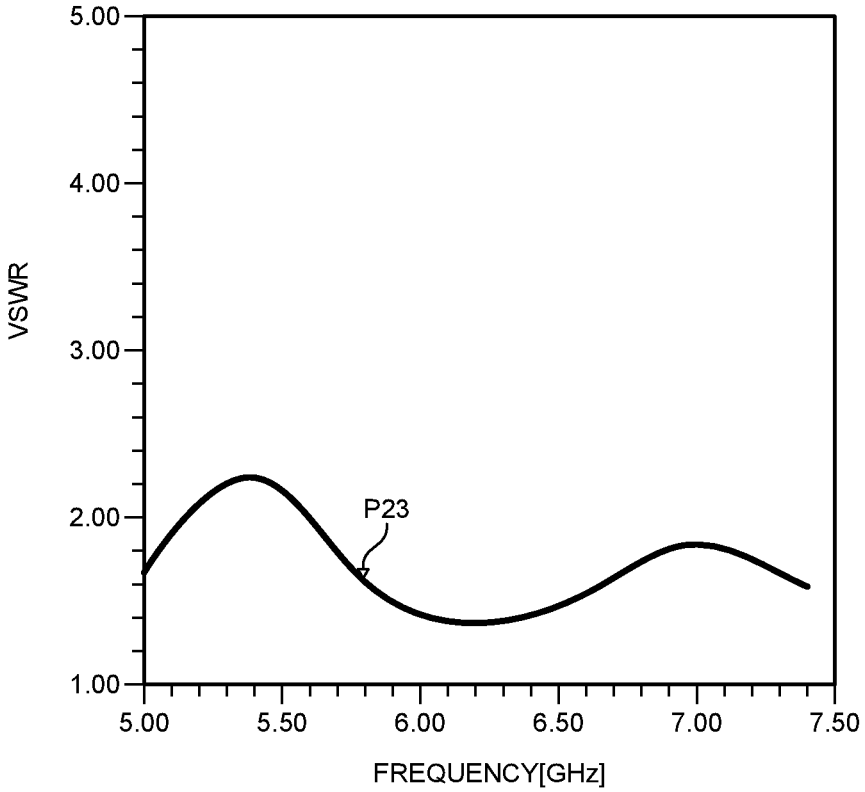
FIG. 32 is a graph of the VSWR of the antenna according to the second embodiment.
Figure 33:
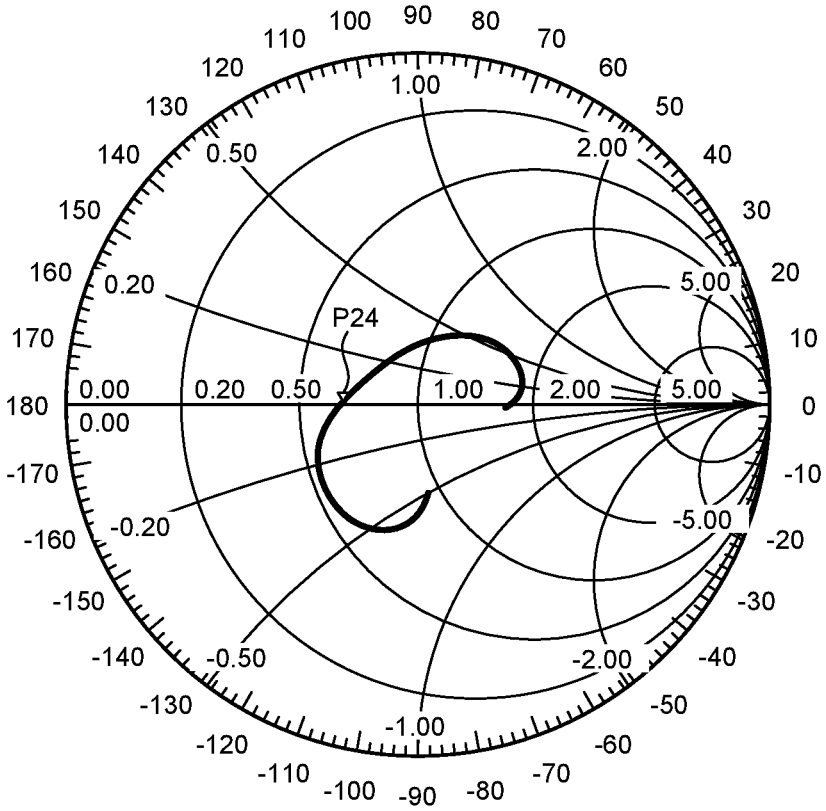
FIG. 33 is a Smith chart that illustrates the characteristic impedance of the antenna according to the second embodiment.
Figure 34:
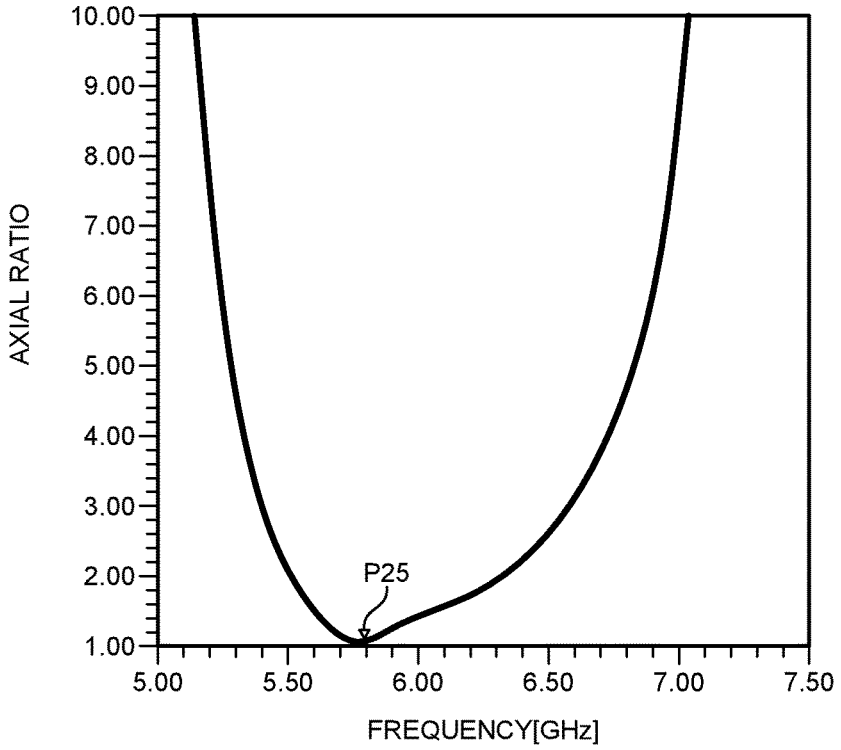
FIG. 34 is a graph of the axial ratio of the antenna according to the second embodiment.
Figure 35:
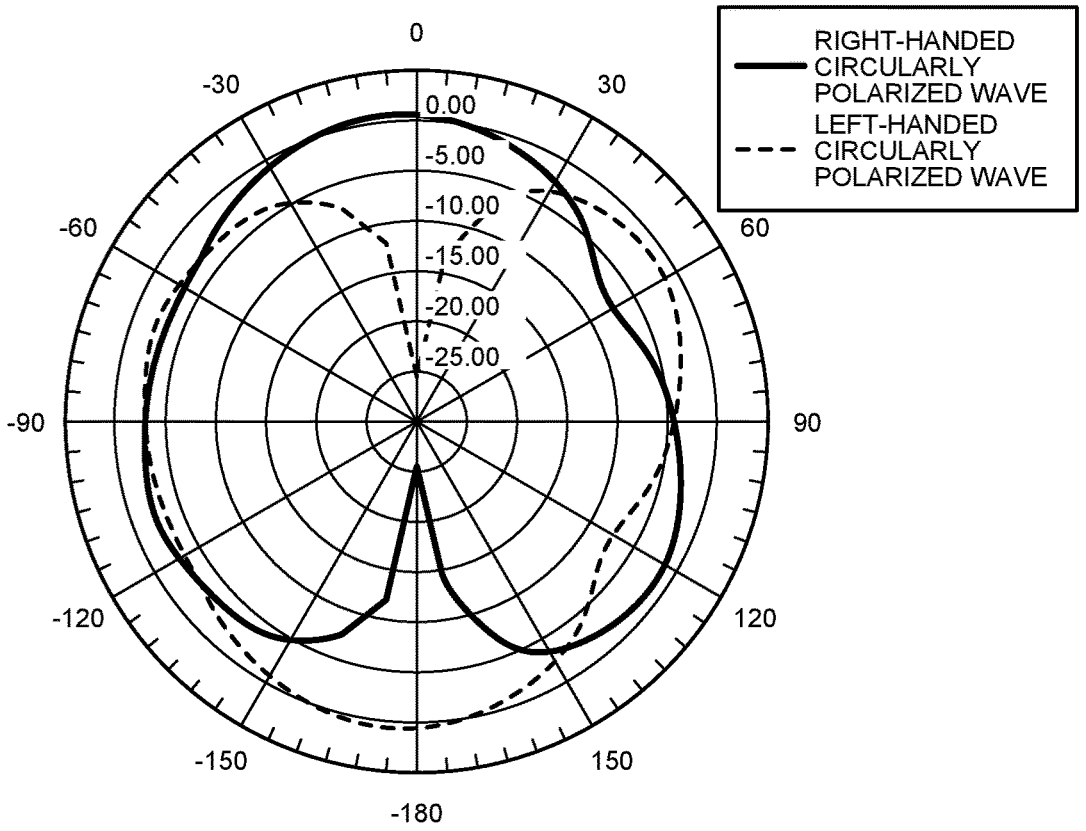
FIG. 35 is a chart that illustrates directivity of the antenna according to the second embodiment.

Simulations have been conducted on the antenna 1E of the second embodiment, and the results of the simulations will now be described. FIG. 31 is a graph of XPD values of the antenna 1E. In FIG. 31, the y-axis represents the XPD value, and the x-axis represents the frequency. In FIG. 31, the simulation demonstrates that the antenna 1E has a value of XPD of approximately 27 dB (P22 in the graph), at a frequency of 5.8 GHz. The result indicates that the gain of the left-handed circularly polarized wave is low. FIG. 32 is a graph of the VSWR of the antenna 1E. In FIG. 32, the y-axis represents the VSWR, and the x-axis represents the frequency. In FIG. 32, the simulation demonstrates that the antenna 1E has a VSWR of approximately 1.6 (P23 in the graph), at a frequency of 5.8 GHz. The result indicates that reflection is relatively small. FIG. 33 is a Smith chart that illustrates the characteristic impedance. In FIG. 33, the simulation demonstrates that the magnitude of reflection is approximately 0.23 and the phase is approximately −179 (P24 in the graph) at a frequency of 5.8 GHz. The results indicate that reflection is relatively small. FIG. 34 is a graph of the axial ratio. In FIG. 34, the y-axis represents the axial ratio, and the x-axis represents the frequency. In FIG. 34, the simulation demonstrates that the antenna 1E has an axial ratio of approximately 1.1 dB (P25 in the graph), at a frequency of 5.8 GHz. The result indicates that the axial ratio is relatively good. FIG. 35 is a chart that illustrates directivity. In FIG. 35, the simulation demonstrates that the right-handed circularly polarized wave and the left-handed circularly polarized wave are symmetrical to each other and that there is a symmetry in directivity between the circularly polarized waves. The symmetry allows the outer conductor 10E to receive the left-handed circularly polarized wave with the antenna 1E turned over. In receiving the left-handed circularly polarized wave, the inner conductor 30E has the circular portion 31E extended clockwise from the starting point 31*a* to the end point 31*b*, in the top-down view of the mounting surface 2.

As described above, the antenna 1E according to the second embodiment includes the outer conductor 10E having a length corresponding to one wavelength of the right-handed circularly polarized wave of an ETC and includes the inner conductor 30E having a length determined based on one wavelength of the left-handed circularly polarized wave of the ETC and consisting of the circular portion 31E and the connection portion 32. The antenna 1E configured as above is allowed to decrease the gain of the left-handed circularly polarized wave and to increase the electrical efficiency. Furthermore, the antenna 1E has a symmetry in directivity, which allows the outer conductor 10E to receive the left-handed circularly polarized wave with the antenna 1E turned over.

Figure 36:
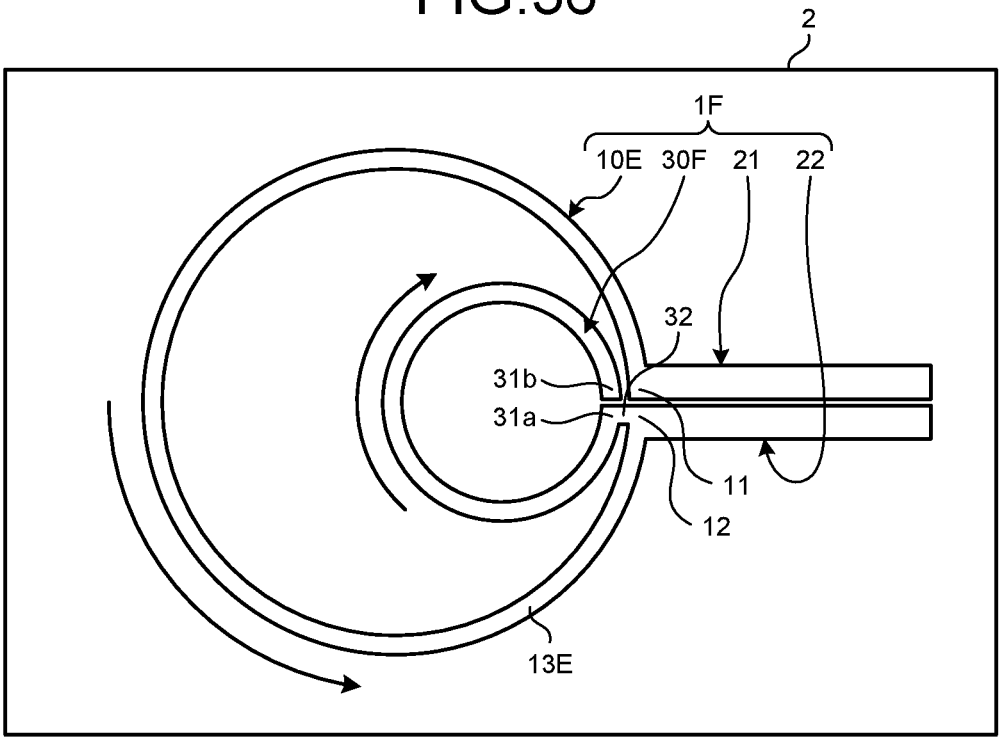
FIG. 36 is a front view of an example configuration of an antenna according to a modification of the second embodiment.
Figure 37:
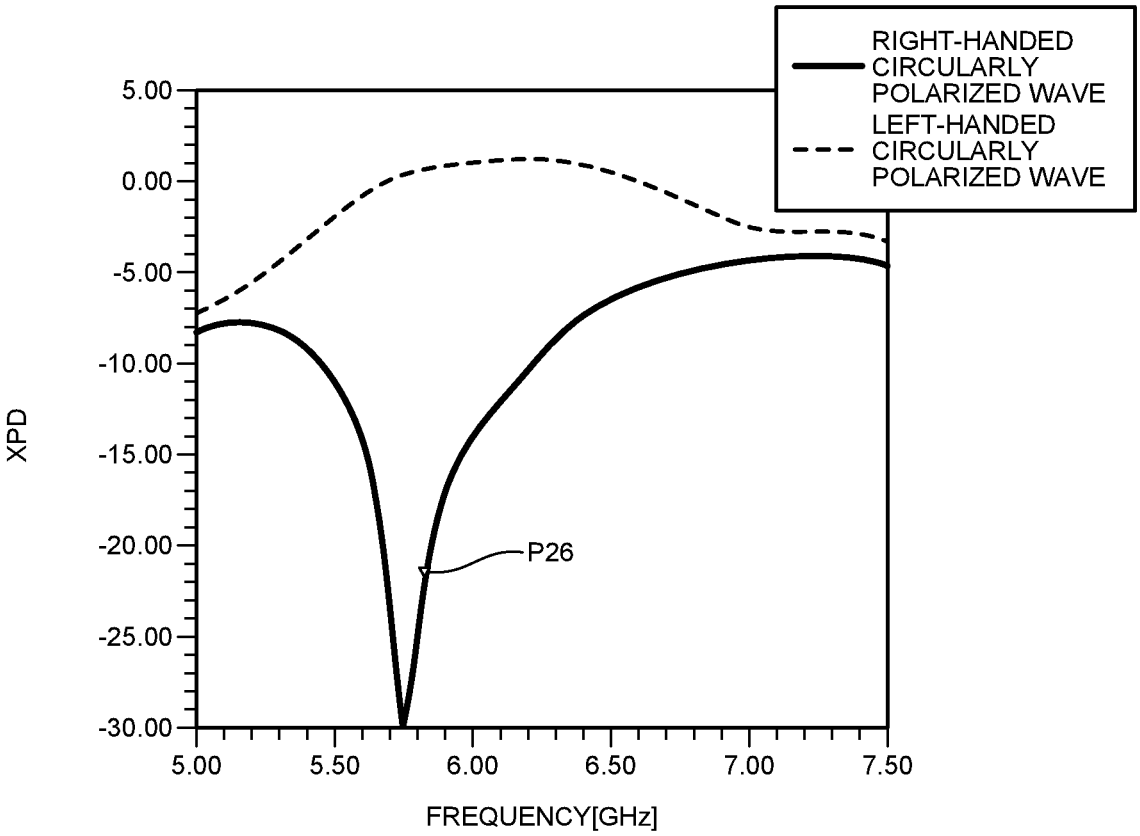
FIG. 37 is a graph of XPD values of the antenna according to the modification of the second embodiment.
Figure 38:
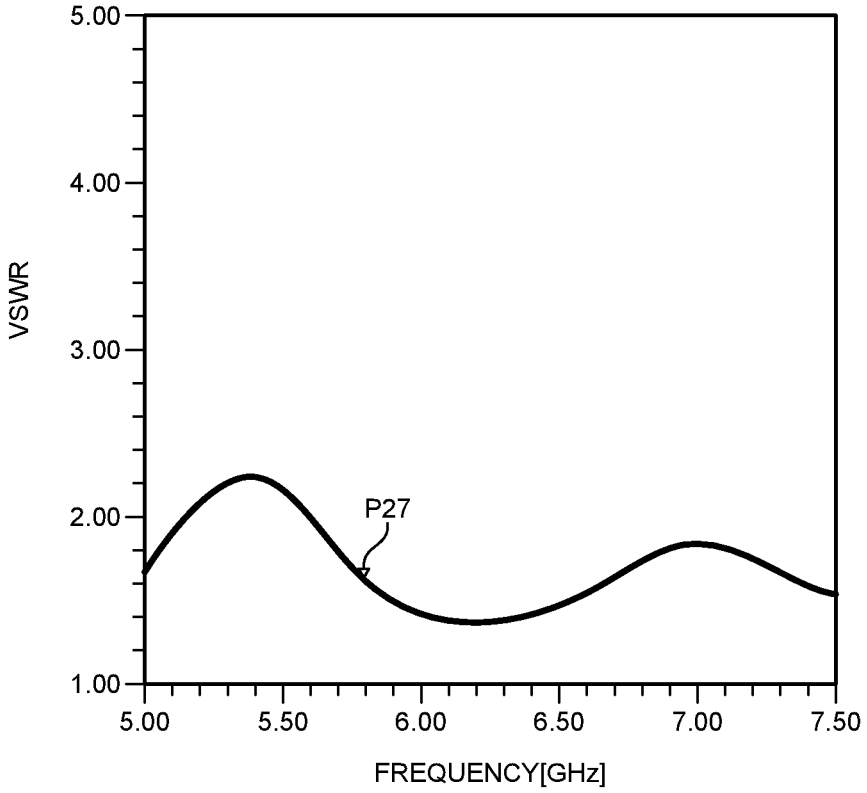
FIG. 38 is a graph of the VSWR of the antenna according to the modification of the second embodiment.

The first embodiment, the first to the fourth modifications of the first embodiment, and the second embodiment have presented examples in which the starting point 31*a* is connected to the first feed point 11 as the negative electrode; however, these examples are not limiting. As demonstrated by an antenna 1F of a modification of the second embodiment, the starting point 31*a* of an inner conductor 30F may be connected to the second feed point 12 as the positive electrode (see FIG. 36). In this case, the antenna 1F receives a left-handed circularly polarized wave with the gain characteristics of the right-handed and left-handed circularly polarized waves inverted. FIG. 37 is a graph of XPD values of the antenna 1F. In FIG. 37, the y-axis represents the XPD value, and the x-axis represents the frequency. In FIG. 37, the simulation demonstrates that the antenna 1F has a value of XPD of approximately 22 dB (P26 in the graph), at a frequency of 5.8 GHz. The result thus indicates that the gain of the right-handed circularly polarized wave is low. FIG. 38 is a graph of the VSWR of the antenna 1F. In FIG. 38, the y-axis represents the VSWR, and the x-axis represents the frequency. In FIG. 38, the simulation demonstrates that the antenna 1F has a VSWR of approximately 1.6 (P27 in the graph), at a frequency of 5.8 GHz. The result thus indicates that reflection is relatively small.

The antennas of the first embodiment, the first to the fourth modifications of the first embodiment, the second embodiment, and the modification of the second embodiment are capable of receiving GPS signals and ETC signals by changing the lengths of the outer conductors 10 and 10E and the inner conductors 30, 30B, 30C, 30D, 30E, and 30F.

An antenna according to the present embodiment includes an outer conductor the length of which corresponds to one wavelength of a right-handed circularly polarized wave and an inner conductor disposed inside the outer conductor and having a length determined based on one wavelength of a left-handed circularly polarized wave and causing current to flow therein in a direction opposite to the current flow in the outer conductor. The antenna configured as above can keep current of a left-handed circularly polarized wave from flowing to the outer conductor and to properly receive a right-handed circularly polarized wave.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An antenna comprising:

an outer conductor formed of a first linear conductor, the first linear conductor having a length corresponding to one wavelength of either one of a right-handed circularly polarized wave and a left-handed circularly polarized wave, circularly extended from a first end to a second end, and causing current to flow between the first end and the second end; and an inner conductor disposed inside the outer conductor, the inner conductor including a curved portion formed with a second linear conductor curvedly extended between a starting point and an end point, the second linear conductor having a length determined based on one wavelength of another one of the right-handed circularly polarized wave and the left-handed circularly polarized wave, and being different from the first linear conductor, the inner conductor having the starting point connected to either one of the first end and the second end, having the end point kept free from connection at a location inside the outer conductor, and causing current to flow in a direction opposite to a flow in the outer conductor.

2. The antenna according to claim 1, wherein the outer conductor and the inner conductor are mounted on a mounting surface, when the outer conductor receives the right-handed circularly polarized wave, the inner conductor is extended counterclockwise from the starting point to the end point in a top-down view of the mounting surface, and when the outer conductor receives the left-handed circularly polarized wave, the inner conductor is extended clockwise from the starting point to the end point in a top-down view of the mounting surface.

3. The antenna according to claim 1, wherein the inner conductor has a circular portion circularly formed as the curved portion.

4. The antenna according to claim 2, wherein the inner conductor has a circular portion circularly formed as the curved portion.

5. The antenna according to claim 1, wherein the inner conductor has a rectangular portion rectangularly formed as the curved portion.

6. The antenna according to claim 2, wherein the inner conductor has a rectangular portion rectangularly formed as the curved portion.

7. The antenna according to claim 1, wherein the inner conductor has an L-shaped portion formed in a shape of L, as the curved portion.

8. The antenna according to claim 2, wherein the inner conductor has an L-shaped portion formed in a shape of L, as the curved portion.

* * * * *